United States Patent [19]

Laditka

[11] Patent Number: 4,958,955

[45] **Date of Patent: * Sep. 25, 1990**

[54] METHODS AND APPARATUS FOR DISPENSING, MIXING AND APPLYING COATING CONSTITUENTS TO TRAFFIC SURFACES USING TANDEM OPERATED SETS OF ROTARY TOOLS

[76] Inventor: Alexander Laditka, 4741 Dalebridge #C-10, Warrensville Hts., Ohio 44128

[ * ] Notice: The portion of the term of this patent subsequent to Oct. 16, 2001 has been disclaimed.

[21] Appl. No.: 368,084

[22] Filed: Jun. 19, 1989

Related U.S. Application Data

[63] Continuation of Ser. No. 213,449, Jun. 28, 1988, abandoned, which is a continuation of Ser. No. 85,253, Aug. 11, 1987, abandoned, which is a continuation of Ser. No. 892,337, Aug. 1, 1986, abandoned, which is a continuation-in-part of Ser. No. 532,742, Sep. 16, 1986, Pat. No. 4,603,999, which is a continuation-in-part of Ser. No. 408,484, Aug. 16, 1982, Pat. No. 4,477,203.

[51] Int. Cl.[5] ..... E01C 7/06

[52] U.S. Cl. ..... 404/75; 404/111; 404/112

[58] Field of Search ..... 404/75, 108–113, 404/101, 118; 15/49 R, 50 R, 98, 384, 385; 16/24, 25, 36, 41; 51/177; 299/41; 251/8, 121; 366/309, 312, 345, 346

[56] References Cited

U.S. PATENT DOCUMENTS 782,459 2/1905 Morris ..... 222/368
831,494 9/1906 Alexander ..... 16/24

(List continued on next page.)

FOREIGN PATENT DOCUMENTS 945037 12/1963 United Kingdom ..... 15/49 R

OTHER PUBLICATIONS

*Now the Seal-Rite Applicator* brochure, Seal-Rite Applicator, Inc., (date unknown).
An untitled brochure published by Erie-Go Manufacturing Co., (date unknown).
*Applicator for Emulsified Asphalt & Tar Seal Coat Materials,* Pavers Mfg. Co., (date unknown).
*Specialized Sealcoating Equipment for Quality Jobs,* Contract Asphalt Maintenance Co., (date unknown).
*Seal-Master, Asphalt Maintenance Equipment,* by Wikel, (date unknown).
*Seal-Mor,* Neal Mfg. Co., Inc., (date unknown).
*Seal Master Blacktop Sealing Machine* brochure, Wikel Mfg. Co., (date unknown).
*Huber SC-150 Sealcoat Applicator* brochure, Huber Corp., (date unknown).
*Nu-Surf Seal Applicator* brochure, Gierhart Machinery Co., (date unknown).
*Asphalt Sealing Machine* brochure, Allied Steel & Tractor Products, Inc., (date unknown).
*The New Surf-Seal for Asphalt Sealcoating* brochure, Specialized Equipment of Wakeman, (date unknown).
*Seal-Master Applicator* brochure, Winkel Mfg. Co., (date unknown).
*Now the Erie Applicator* brochure, Erie Applicator, Inc., (date unknown).

*Primary Examiner*—Jerome W. Massie, IV
*Assistant Examiner*—Gay Ann Spahn
*Attorney, Agent, or Firm*—David A. Burge

[57] ABSTRACT

A system for applying a coating to a traffic surface utilizes a power driven apparatus that provides a plurality of sets of applicator tools that are rotated in tandem to effect mixing in situ of traffic surface coating constituents, and to effect a controlled application of the resulting coating. The apparatus includes a transport carriage that mounts an array of horizontally spaced bearing assemblies, each of which journals a separate vertically extending drive shaft for rotation about a separate vertically extending center axis. Each of the drive shafts drivingly connects with a separate set of the rotary applicator tools. The tools of each set extend substantially horizontally in a radial array about the center axis of its associated drive shaft. A power drive system rotates the sets of applicator tools in tandem as the carriage is moved across a traffic surface. Also described are methods of employing the apparatus to mix coating constituents in situ and to effect their appliction to a traffic surface.

33 Claims, 17 Drawing Sheets

U.S. PATENT DOCUMENTS

| | | | |
|---|---|---|---|
| 1,224,294 | 5/1917 | Franzen | 16/27 |
| 1,437,863 | 12/1922 | Raymond | 222/317 |
| 1,591,682 | 7/1926 | Ponselle | 51/177 |
| 1,914,950 | 6/1933 | Kanen | 404/111 |
| 2,033,510 | 3/1936 | Brayley | 16/24 |
| 2,175,511 | 10/1939 | Wahlstrom et al. | 404/111 |
| 2,200,921 | 5/1940 | Granell | 51/177 |
| 2,241,214 | 5/1941 | Milster | 188/152 |
| 2,277,389 | 3/1942 | Conway | 404/112 |
| 2,668,976 | 2/1954 | Beach | 15/230 |
| 2,717,725 | 9/1955 | Bennett | 222/485 |
| 2,725,945 | 12/1955 | Beaudoux et al. | 180/6.24 |
| 2,754,733 | 7/1956 | Beyer | 404/112 |
| 2,779,965 | 2/1957 | Schilberg | 16/41 X |
| 2,796,202 | 6/1957 | Lawrence et al. | 222/233 |
| 2,796,203 | 7/1957 | Masters et al. | 222/311 |
| 2,799,037 | 7/1957 | Grogan | 15/172 |
| 2,835,420 | 5/1958 | Foley | 222/485 |
| 2,962,946 | 12/1960 | Neff | 404/101 |
| 3,130,653 | 4/1964 | Talbott | 404/112 |
| 3,153,992 | 10/1964 | Dabelle | 404/111 |
| 3,183,803 | 5/1965 | Gierhart | 404/111 |
| 3,187,845 | 6/1965 | Ashley, Jr. et al. | 188/16 |
| 3,206,174 | 9/1965 | Young | 366/8 |
| 3,221,619 | 12/1965 | Erickson | 404/112 |
| 3,241,976 | 3/1966 | Rank et al. | 404/111 |
| 3,245,329 | 4/1966 | Nagin et al. | 404/75 |
| 3,279,337 | 10/1966 | Weaver | 404/111 |
| 3,283,675 | 11/1966 | Gifford et al. | 404/111 |
| 3,305,887 | 2/1967 | Turner | 15/50 R |
| 3,333,518 | 8/1967 | Sholl et al. | 404/92 |
| 3,452,381 | 7/1969 | Bratti | 15/98 |
| 3,458,885 | 8/1969 | Danielsson | 15/50 |
| 3,515,041 | 6/1970 | Murtaugh | 404/108 |
| 3,533,336 | 10/1970 | Wikel | 404/111 |
| 3,550,866 | 12/1970 | Swenson | 239/677 |
| 3,559,543 | 2/1971 | Schwoebel, Jr. | 404/101 |
| 3,580,638 | 5/1971 | Pullen | 299/41 |
| 3,683,761 | 8/1972 | Babic | 404/112 |
| 3,703,856 | 11/1972 | Wikel et al. | 404/111 |
| 3,771,893 | 11/1973 | Miller | 404/101 |
| 3,776,430 | 12/1973 | Grandrud | 222/177 |
| 3,791,754 | 2/1974 | Zochil | 404/112 |
| 3,807,634 | 4/1974 | Vogt | 239/150 |
| 3,841,779 | 10/1974 | Ray | 404/111 |
| 3,936,212 | 2/1976 | Holz, Sr. et al. | 404/112 |
| 3,989,403 | 11/1976 | Verive | 404/111 |
| 4,074,385 | 2/1978 | Howard et al. | 15/180 |
| 4,096,879 | 6/1978 | Serur et al. | 251/121 |
| 4,172,580 | 10/1979 | Raftis et al. | 251/8 |
| 4,302,127 | 11/1981 | Hodson | 404/102 |
| 4,302,128 | 11/1981 | Thatcher | 404/108 |
| 4,315,700 | 2/1982 | Heiligtag et al. | 404/111 |
| 4,318,631 | 3/1982 | Vickers | 404/118 X |
| 4,350,293 | 9/1982 | Lestradet | 239/155 |
| 4,357,953 | 11/1982 | Patterson | 137/88 |
| 4,365,377 | 12/1982 | Todd et al. | 15/98 |
| 4,477,203 | 10/1984 | Laditka | 404/112 X |
| 4,603,999 | 8/1986 | Laditka | 404/112 |

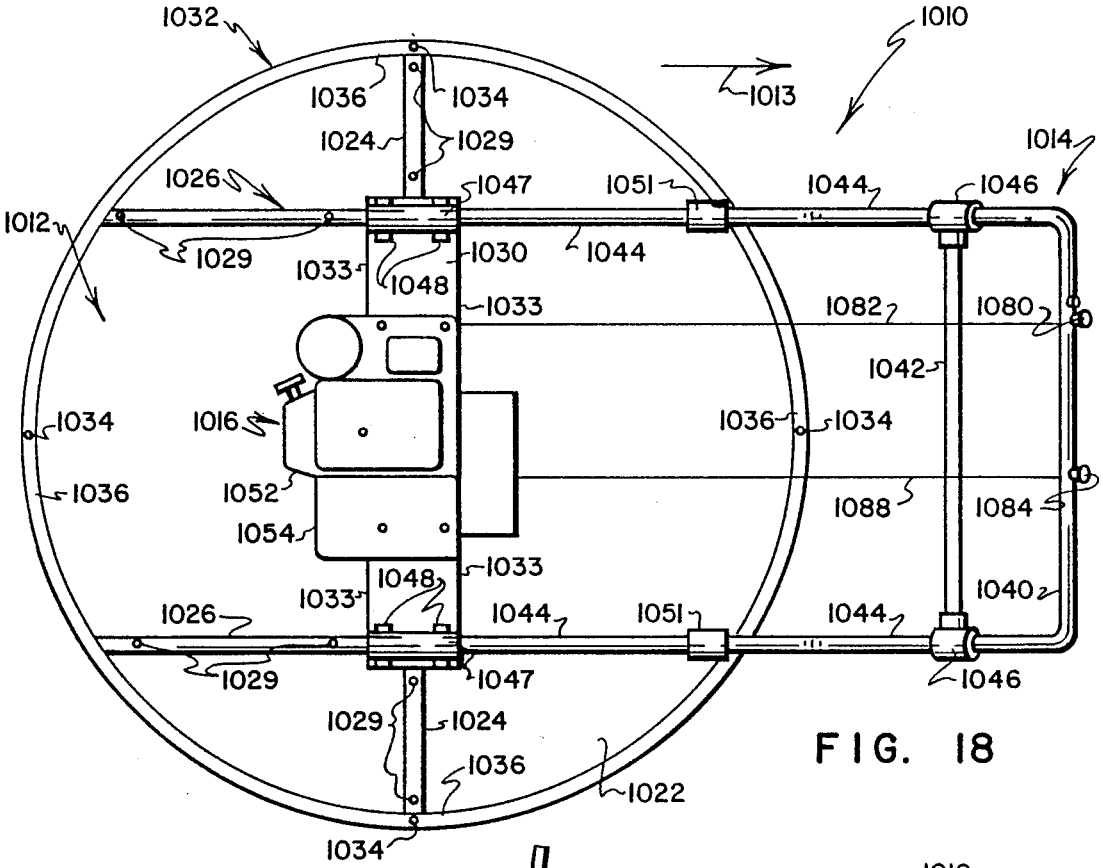
FIG. 18
FIG. 19
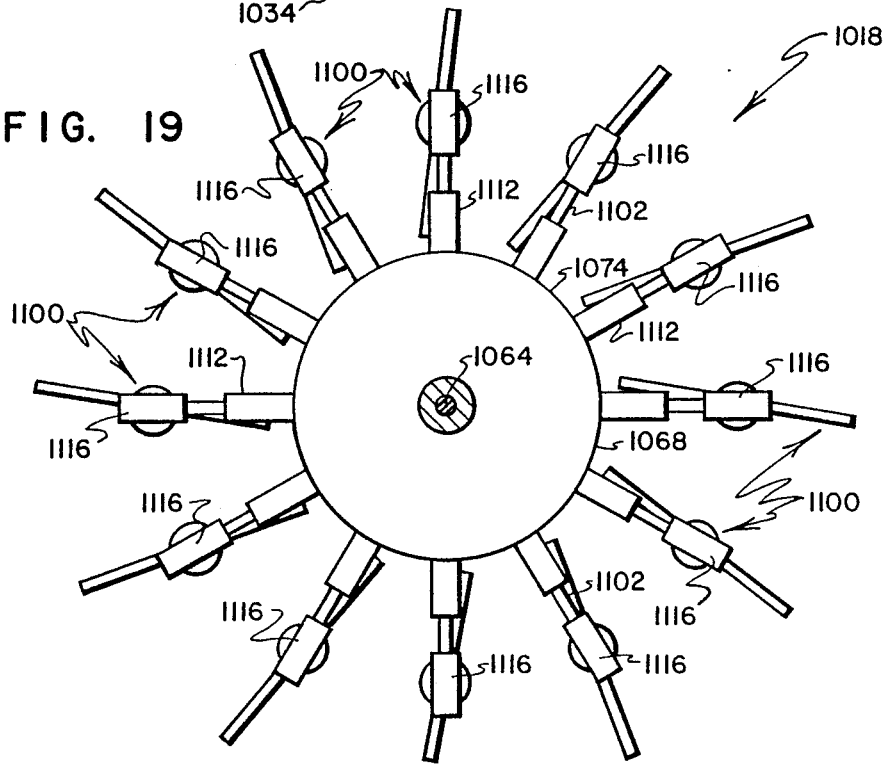

METHODS AND APPARATUS FOR DISPENSING, MIXING AND APPLYING COATING CONSTITUENTS TO TRAFFIC SURFACES USING TANDEM OPERATED SETS OF ROTARY TOOLS

The present application is a continuation of application Ser. No. 213,449, filed June 28, 1988, now abandoned, as a continuation of application Ser. No. 085,253 filed Aug. 11, 1987, now abandoned, as a continuation of application of Ser. No. 892,337 filed Aug. 1, 1986, now abandoned as a continuation-in-part of application Ser. No. 532,742 filed Sept. 16, 1983 (issued Aug. 5, 1986 to Alexander Laditka as U.S. Pat. No. 4,603,999 entitled APPARATUS FOR MIXING AND SPREADING COATINGS ON SURFACES), hereinafter referred to as the "Parent Case," which, in turn, was filed as a continuation-in-part of application Ser. No. 408,484 filed Aug. 16, 1982 (issued Oct. 16, 1984 to Alexander Laditak as U.S. Pat. No. 4,477,203 entitled APPARATUS AND METHOD FOR APPLYING COATINGS TO TRAFFIC SURFACES), hereinafter referred to as the "Grandparent Case." The disclosures of the Parent Case and the Grandparent Case are incorporated herein by reference.

BACKGROUND OF THE INVENTION

1. Field of the Invention

The present invention relates to the application of coating constituents to form desired types of coatings on relatively large surface areas that characteristically are referred to as "traffic surfaces," typically roadway surfaces such as highways, streets, driveways, parking lots, runways, taxiways, and tarmacs that are of sufficient size to warrant the use of relatively large power operated machinery to dispense and mix coating constituents to form desired types of coating materials, and apply the mixed materials to form coatings of a desired character that are intended to protect, restore, and enhance traffic surface integrity.

More particularly, the present invention relates to a system for dispensing coating constituents onto a traffic surface, for mixing the dispensed constituents in situ on the the traffic surface, and for effecting a controlled application of the resulting coating by utilizing a novel and highly versatile apparatus that includes a plurality of rotary finishing units, with each of the rotary finishing units including a separate set of rotary applicator tools, with the tools of each set being mounted for rotation about a separate vertically extending axis, and with the sets of tools being rotated in tandem by a power drive system to enable a very large traffic surface area to be coated quickly, easily, and in a desired manner utilizing any of a wide variety of coating constituents to effect a coating application that has desired characteristics. 2. Prior Art Two terms known to those skilled in the art are used herein and should be defined, for both of the terms can be interpreted relatively broadly or relatively narrowly, whereby their precise meanings can differ. The terms are "traffic surface" and "tandem." Both of these terms are used herein in a relatively broad sense rather than a relatively narrow sense.

The term "traffic surface" is used in a generic sense to refer to a wide class of substantially horizontal surfaces such as highways, streets, driveways, parking lots, runways, taxiways, tarmacs, floors of large garages and industrial buildings, loading dock decks, and the like that need to be coated from time to time to protect, restore, and enhance surface integrity.

The term "tandem" is used in a generic sense to indicate a cooperative mounting and operating relationship between and among sets of applicator tools that are rotated concurrently, whereby, for example, tandem sets of concurrently rotating applicator tools cooperate with each other so that the resulting mixing and application functions they perform tend to be enhanced by their concurrent and cooperative rotation. The term "tandem," as used in this document, is further intended to encompass a variety of relative positionings of the rotary finishing units (i.e., the sets of rotary tools), for example arrangements wherein the vertical axes of rotation of the sets of tools are spaced forwardly and rearwardly relative to a forward path of travel that is followed by the apparatus in moving across a traffic surface (and/or a transverse, side-by-side relationship of selected ones of these axes, etc.).

Because traffic surfaces are exposed to wear and often to the effects of the elements, they are subject to deterioration and periodically require the application of coatings to protect, restore, and enhance their integrity, and to thereby extend their useful lives. Some traffic surfaces should be coated when constructed, as by the application of a coating that seals the surface and thereby protects against water penetration that, in winter, can cause spalding or cracking. Many traffic surfaces require protective and reconditioning coatings periodically and/or after the surfaces have been subjected to a certain amount of use.

Due to the wide variety of materials that are used to form traffic surfaces, the wide range of uses to which traffic surfaces are subjected, and the many types of coating constituents that are available to protect against specific kinds of wear and deterioration, there has been a longstanding need for a highly versatile system for dispensing, mixing, and applying coatings to traffic surfaces. The need has been particularly pressing with respect to the protective coating of traffic surfaces of large area such as highways, airport runways, bridge roadways, and the like where manual dispensing, mixing, and application of coating constituents is utterly impractical.

While a variety of proposals have been made for apparatus to dispense, mix, and coat large traffic surfaces, most prior proposals have been characterized by drawbacks such as a lack of versatility of the apparatus to dispense, mix, and apply coating constituents of a wide range of kinds and types, and a lack of adjustability to enable coating applications to be made that differ in desired ways such as thickness and the degree to which the resulting coating conforms to the shape of the surface being coated (e.g., whether the coating tends to smooth or diminish surface irregularities). Indeed, the problems that are associated with efforts to provide a highly versatile traffic surface coating system have been deemed to be so extensive in character that it has become standard practice to design and build traffic surface coating apparatus such that it is intended to apply only a limited selection of coating constituents, with the apparatus being designed for use on only selected types of traffic surfaces.

A further drawback of most prior traffic surface coating apparatus proposals is that their components and systems are not readily adapted to be scaled upwardly or downwardly in size and capability to provide a complete line of highly versatile coating dispensing, mixing, and applicator machines. Stated in another way, a drawback of prior proposals for traffic surface coating apparatus resides in the fact that, while what has been proposed may serve its intended purpose within a limited range of functions for a specific size of machine and type of traffic surface, prior proposals are not well adapted for use with larger or smaller machines, for performing multiple coating functions or applying a variety of coating constituents, and/or for use in protectively coating other types of traffic surfaces. Rather, certain types of system proposals have been made for use in coating concrete sidewalks; others have been proposed for use in coating roofs of buildings; others for use in coating parking lot surfaces; and still other types of systems have been proposed for coating very large applications such as highways and airport runways -- with variations of many of these proposals being offered for use with specific different types of coating constituents.

In short, prior system proposals have not only been lacking in versatility with respect to the type of coating constituents and the type of traffic surface materials with which they are intended to be used, but also have been lacking in versatility from the viewpoint that the approaches they utilize to effect dispensing, mixing and application of coating constituents have not been found to be acceptable for use across a product line of coating apparatus ranging from small machines for relatively narrow coating applications such as sidewalks to large machines for vastly extensive coating applications such as highways and runways.

Still another drawback common to the vast majority of previous proposals for traffic surface coating apparatus is that the spreading and applicator tools used by the proposed machines are not well suited for treating surfaces which have significant surface variations or which require a repetitive blading action to effect proper feeding and/or troweling of material into and about large cracks. Stated in another way, the application tools used by the apparatus of most prior proposals are lacking in versatility and in capability to cope with traffic surface variations.

A further and significant limitation of prior applicator proposals is their inability to effectively admix in situ materials such as epoxy substances, fibrous, beaded, or heavy particulates, and/or quick-setting soluble substances to form uniform slurry compositions. 3. The Referenced Parent and Grandparent Cases The referenced Grandparent Case addresses certain of the foregoing and other drawbacks of prior proposals by providing a novel and improved system that features a sufficient degree of versatility to enable its use in applying coatings to traffic surfaces of a wide range of sizes.

The referenced Parent Case addresses the need for a simple and inexpensive system for spreading and applying surface coating ingredients utilizing a machine that is manually maneuvered with ease and that is well suited to accommodate traffic surfaces of moderate size which have closely confined boundaries, changing contours, and/or significant surface irregularities.

The proposals of both of the Parent and Grandparent Cases utilize rotary applicator tools that are of a highly versatile character and that have an inherent capability to cope with significant variations of the surfaces on which coatings are being applied.

SUMMARY OF THE INVENTION

The present invention addresses the foregoing and other drawbacks of the prior art by providing a system that is capable of dispensing, mixing, and applying coating constituents on smooth and/or irregular traffic surfaces of relatively large size, wherein a power driven apparatus is utilized that carries an array of sets of rotary tools, with the tools of each set being rotated about a separate, substantially vertically-extending axis, and with sets of tools functioning in tandem to enhance the character of the resulting coating application.

The present invention represents the work product of a continuing development program that also generated the subjects matter of the referenced Parent and Grandparent Cases. An aspect of the present invention resides in the use that is made of the technology and the subjects matter of the invention proposals of the Parent and Grandparent Cases, as by providing a relatively large scale apparatus that employs a plurality of sets of rotary tools of the basic type that are utilized with the systems of the Parent and Grandparent Cases, but with the tools of each set being rotated about a separate substantially vertically extending axis, and with sets of tools being arranged and driven in tandem so as to cooperate in enhancing the character of the coating application that is made by the apparatus. Other aspects of the present invention reside in the provision of methods and apparatus that differ from the single-axis rotary tool systems that are described in the Parent and Grandparent Cases, whereby the present invention succeeds in providing a highly versatile system for dispensing, mixing, and applying coating constituents of a wide variety of types on traffic surfaces of widely differing characteristics and sizes.

Still another feature of the present invention is that its system proposals may be scaled up and down from the configuration of the apparatus that is described as embodying the preferred practice, to provide an essentially complete line of surface finishing machines which enable almost any conceivable size of traffic surface to be coated with almost any conceivable combination of coating constituents.

An apparatus embodying the preferred practice of the invention includes a support carriage, a frame and a plurality of power-driven finishing assemblies. Each of the finishing assemblies is provided with a plurality of horizontally extending working tools that are rotated about an associated vertically-extending central axis to bring the tools into contact with a traffic surface area being treated to efficiently spread and apply a surface treatment composition. The rotary tools of each of the finishing assemblies are arranged in a substantially radially extending array about its associated central axis, and a common power source rotates the finishing assemblies about their associated center axes.

In one form of practice of the present invention, at least some of the finishing assemblies are arranged side-by-side so that, as the apparatus is moved forwardly along a path of travel, each of the side-by-side finishing assemblies treats a separate portion of the width of a treatment zone that is served by the apparatus.

In another form of practice, at least some of the finishing assemblies are arranged forwardly and rearwardly with respect to each other so that as the apparatus is moved along its forward travel path, the forward and rearward finishing assemblies are brought sequentially into contact with portions of the treatment zone.

In this latter form of practice, it is possible (and, indeed preferable in many instances) to utilize the forward and rearward finishing assemblies to serve different but complementary functions. For example, the forward finishing assemblies can have their rotary applicator tools urged into contact with the traffic surface area being treated, whereby the forward finishing assemblies serve to mix coating constituents and to work the constituents into the pores of the surface that is being treated -- whereas the rearward finishing assemblies can have their rotary finishing tools held in spaced relationship above the surface being treated so that they serve to effect a smooth coating of the surface with the coating being applied so that it has a predetermined average coating thickness.

In still another form of practice, the forward finishing assemblies can serve to effect a first mixing in situ of different types of coating constituents that have been deposited forwardly of the forward finishing assemblies; and, if desired, one or more additional deposits of added coating constituents can be made between forward and rearward finishing assemblies, so that the rearward finishing assemblies function to admix the added constituents to the mixture that is prepared by the forward finishing assemblies. Such a staged deposit and sequential application of coating constituents often is desirable in situations where certain coating constituents should be deposited on and at least partially applied to a traffic surface before other coating constituents are added to the mixture of materials that is being applied as, for example, where a liquid that contains a surface wetting agent is desirably dispensed and at least partially applied to a traffic surface by one or more forward finishing assemblies before more viscous constituents such as fluids and/or particulates are admixed and applied in situ by one or more rearward finishing assemblies. Staged or separate deposits of coating ingredients often are desirable for use in effecting applications of liquids that are to be mixed with particulates, or for use in applying reactable fluids such as constituents that harden or cure when mixed to form epoxy coatings, etc.

In preferred practice, a system for applying a coating to a traffic surface utilizes a power driven apparatus that dispenses coating constituents onto the traffic surface, and that provides a plurality of sets of applicator tools that are rotated in tandem to effect mixing in situ of the dispensed constituents and a controlled application of the resulting coating. The apparatus includes a transport carriage that provides storage compartments for containing coating constituents, and that has a dispensing system for controllably dispensing coating constituents from the storage compartments onto traffic surface portions that lie beneath the carriage. An array of horizontally spaced bearing assemblies are mounted on the carriage, each of which journals a separate vertically extending drive shaft for rotation about a separate vertically extending center axis. Each of the shafts drivingly connects with a separate set of the rotary applicator tools, with the tools of each set extending substantially horizontally in a radial array about the center axis of its associated drive shaft. A power drive system rotates the sets of applicator tools in tandem as the carriage is moved across a traffic surface / By this system, coating constituents are dispensed in a controlled manner onto the traffic surface and are mixed in situ beneath the carriage by the rotary action of the sets of rotary tools which cooperate to simultaneously effect a desired type of coating application, Preferably the rotary tools are attached to their respective drive shafts by arms that are adjustable to enable the tools selectively to be urged toward the traffic surface to maintain surface contact, and/or to be held at a controlled height above the traffic surface so that the applied coating has desired characteristics.

In utilizing features of the invention of the Parent Case, each of the sets of rotary applicator tools forms what will be referred to herein as a "finishing assembly" or "finishing unit," with each of the finishing assemblies or units preferably including radially extending arms that connect with the working tools and with a central support disc. The arms are adjustable to selectively and independently urge their associated tools toward the traffic surface to maintain the tools in contact with the surface despite surface variations -- as is described in the Parent Case; alternatively, and in accordance with a feature of the present invention, the arms also may be adjusted to selectively and independently maintain their associated tools spaced above the surface that is being treated by a controlled distance so that the tools function to apply a coating of predetermined average thickness. Further utilizing features of the Parent Case, the arms are provided with a means for adjusting the angle of inclination of each tool relative to its supporting arm so that tilt and lag can be adjusted to minimize tool "chatter" and to optimize such operating characteristics as the troweling effect of blade-like tools that is achieved on a particular surfaoe being treated, Other features of the referenced Parent and Grandparent Cases likewise can be used with the system of the present invention, as will be readily apparent from the description and claims that follow, taken in conjunction with the accompanying drawings. By utilizing features of the referenced cases, a finishing apparatus is provided that is capable of mixing, spreading, and applying coating ingredients with a desired degree of uniformity to traffic surfaces having surface variations and/or irregular contours. Likewise, the resulting apparatus is relatively easy to maneuver, and its direction of travel can be changed relatively abruptly without interrupting or impeding the character of the coating application that is being made to a traffic surface.

Other advantages that result from use of the novel and improved features of the referenced Parent and Grandparent Cases reside in the provision of a finishing apparatus which is capable of effecting uniform, in situ mixing of coating ingredients that range in consistency from very thin, slurry-like liquids to very viscous tar-like gels and/or particulates. Where very viscous ingredients are being used, often it is desirable to utilize arrays of alternating mixing and spreading tools. By way of example (and as is described in detail in the referenced Parent Case), rake-like mixing tools may be used to break up and mix particulate coating ingredients with viscous slurry coatings so that blade-like spreading tools can effect application of coating materials with a desired degree of uniformity.

BRIEF DESCRIPTION OF THE DRAWINGS

The foregoing and other features of the invention will be better understood by referring to the description of the preferred embodiment and the claims which follow, taken together with the accompanying drawings, wherein:

FIG. 18 is a top plan view of the apparatus of FIG. 15;

FIG. 19 is a sectional view as seen from a plane indicated by a line 19—19 in FIG. 15;

DESCRIPTION OF THE PREFERRED EMBODIMENT

Figure 1:
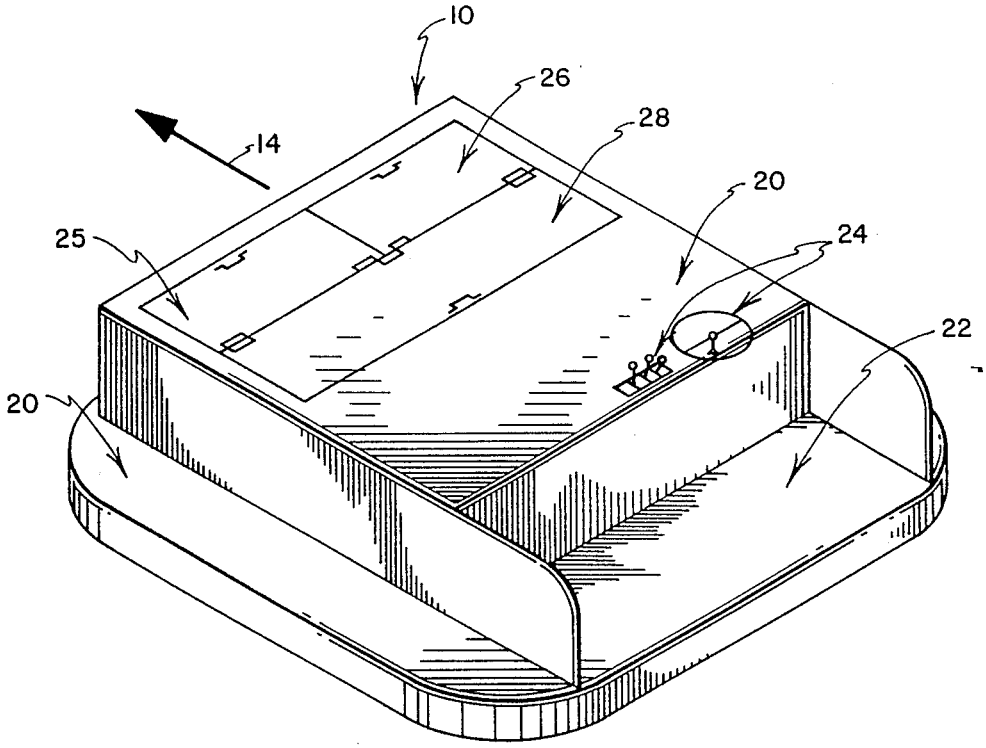
FIG. 1 a perspective view of a surface finishing apparatus that embodies the preferred practice of the present invention, with the apparatus employing a plurality of side-by-side rotary finishing assemblies, and a plurality of forwardly-and-rearwardly positioned finishing assemblies.

Several paragraphs that are extracted from the "Description of the Preferred Embodiment" sections of the referenced Grandparent and Parent Cases (i.e., paragraphs that make reference to FIGURES 9–28 which also are extracted from the referenced Grandparent and Parent Cases) are presented here inasmuch as features that are disclosed in these paragraphs (and in the associated drawings) are referred to in the description of the preferred embodiment of the present invention. So that FIGURE numbers and reference numerals that are used in the referenced Grandparent and Parent Cases will not conflict either with each other, or with numbers and numerals that are used in the present application, drawing numbers extracted from the referenced Grandparent Cast have been increased by adding thereto the number "6"; drawing numbers extracted from the referenced Parent Case have been increased by adding thereto the number "14"; reference numerals that have been extracted from the referenced Grandparent Case have been increased by adding thereto the number "500"; and, reference numerals that have been extracted from the referenced Parent Case have been increased by adding thereto the number "1000." Thus, for example, reference numeral 10 that appears in FIG. 1 of the referenced Grandparent Case is reproduced herein as reference numeral 510 in FIG. 7; and, reference numeral 10 that appears in FIG. 1 of the referenced Parent Case is reproduced herein as reference numeral 1010 in FIG. 15.

DISCLOSURE OF THE REFERENCED GRANDPARENT CASE

Figure 7:
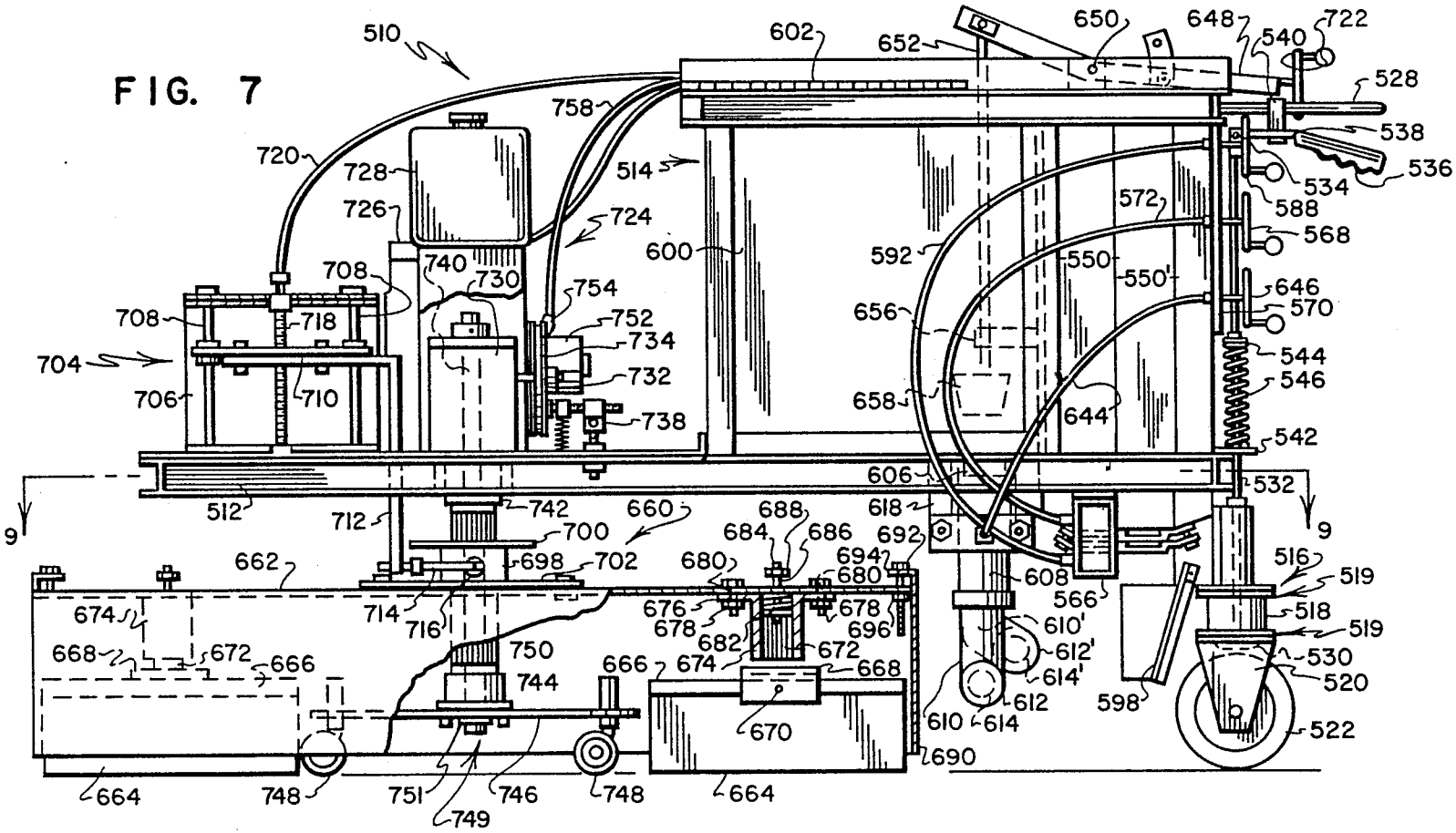
FIG. 7 is a side elevational view of a machine that embodies the preferred practice of the invention of the referenced Grandparent Case, with parts broken away and parts omitted for clarity.

Referring to the accompanying drawing and especially to FIG. 7 thereof, a machine embodying the preferred practice of the invention of the referenced Grandparent Case (Pat. No. 4,477,203) is indicated generally by the numeral 510. The machine includes a primarily horizontal frame 512, at one end of which is a superstructure 514 and depending wheel support structures 516, 516' which include elastomeric shock-absorbing bushing 518, 518' having disc-type bearings 519, 519' at their upper and lower ends, and swivelling forks 520, 520' which rotatably mount a support wheel 522, 522'.

As will be seen, the wheels 522, 522' support one end of the frame 512 upon the surface to be coated. The other end of the frame is supported by a combined tool driving and support mechanism which will be described in detail hereinafter.

The machine being presently described is intended to move about upon the traffic surface by means of the support wheels 522, 522' to effect its coating function, and this movement is brought about manually by means of a U-shaped handle bar 528 which extends athwart the machine at the end including the superstructure 524.

1. BRAKING MEANS FOR MACHINE PATH CONTROL

For a purpose which will hereafter appear, an individual braking mechanism is associated with each of the wheels 522, 522'. In the case of wheel 522 this braking mechanism includes a brake pad 530 connected to the bottom of the end of a relatively rigid thrust rod or cable 521 whose upper end is connected at 534 with one end of an actuating lever 536 which is pivotally connected at 538 to a bracket 540 clamped to one of the legs of the U-shaped handle 528. The pivotal mounting 538 is midway of the lever so that the operator, by drawing the end of the lever upwardly towards the handle 528 causes the rod 532 to be forced downwardly, applying the brake pad 530 to the wheel 522. The brake pad 530 preferably has a rotary connection with the rod 532 which readily allows the wheel 522 and the frame 512 to undergo a relatively swiveling movement while the brake is applied. A spring perch 542 mounted on the frame 512 has a guiding opening through which the rod 532 passes, and the rod has a stop member 544 suitably clamped thereto. Between the perch 542 and the stop 544 is a compression spring 546 which serves to release the brake whenever the operator removes hand pressure from the brake actuating lever 536.

The wheel 522' has a braking mechanism identical to that described for wheel 522, and, for simplicity, the parts have the same numeral designations as for the wheel 522 brake mechanism except that the numerals are primed.

2. STORING AND DISPENSING OF INDIVIDUAL INGREDIENTS

Mounted upon the upper surface of the frame 512 at the end adjacent the wheel 522, 522' and forming a part of the superstructure 514 are a number of containers for holding supplies of individual coating ingredients. These are best seen in FIG. 7 where they are designated by the numerals 550 and 550' which indicate hoppers for particulate material such as sand, glass beads, particles of ground rubber, short staple lengths of fibers such as glass or asbestos, or any of many other such materials used in the compounding of compositions for coating traffic surfaces. The hoppers 550, 550' extend from side to side of the frame 512. The following description will discuss the hopper 550 and its associated mechanisms in detail.

The hopper 550 in its lower portion has a trough with a flat bottom in which is provided a row of uniform and uniformly spaced dispensing ports extending from side to side of the machine. One of these ports can be seen in section as designated by the numeral 552 in FIG. 12. As can also be seen in FIG. 12, each port 552 is actually a series of stacked aligned openings. The uppermost opening of the port is formed in the bottom plate of the hopper 550, and the other two are in guide tracks 554, 556 which underlie and are affixed to the bottom of the hopper 550 for a purpose which will presently appear.

Figure 10:
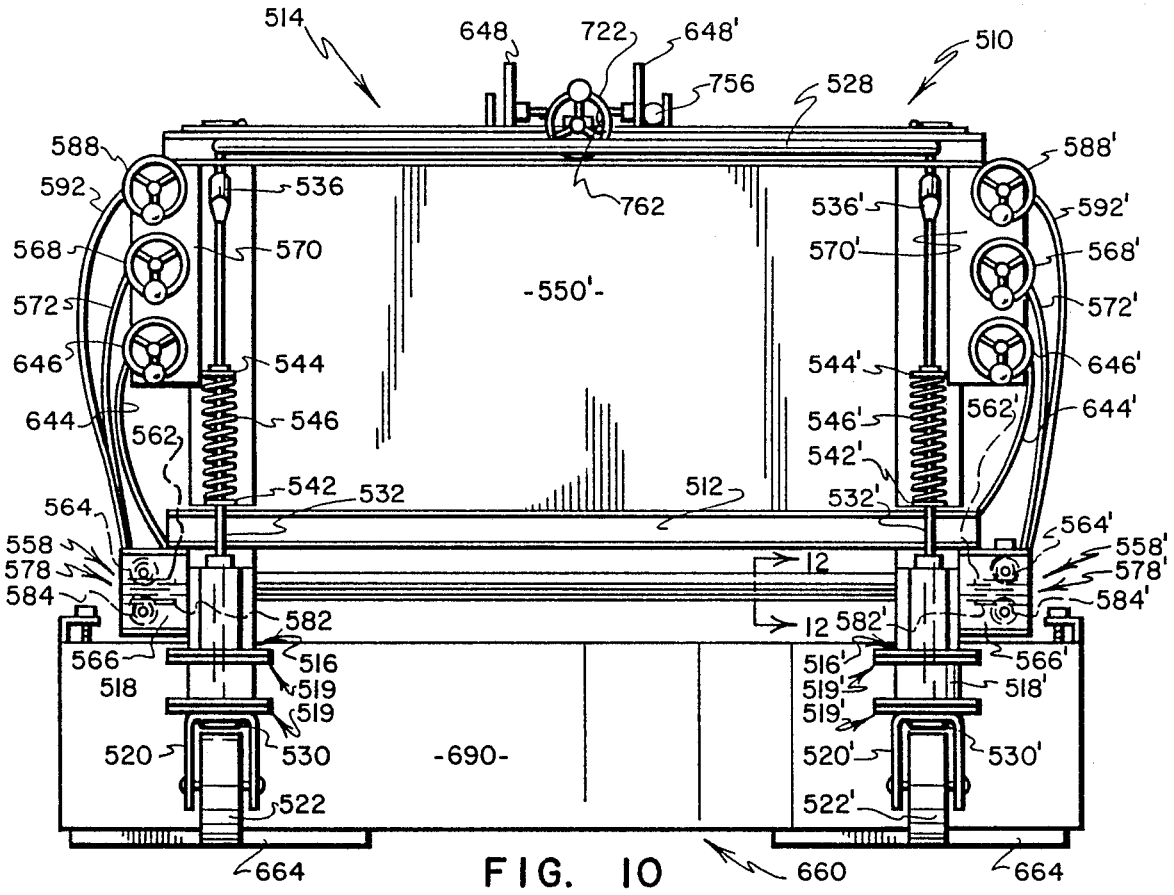
FIG. 10 is an end elevational view of the machine as viewed from the right in FIG. 7, with parts being omitted for clarity.
Figure 12:
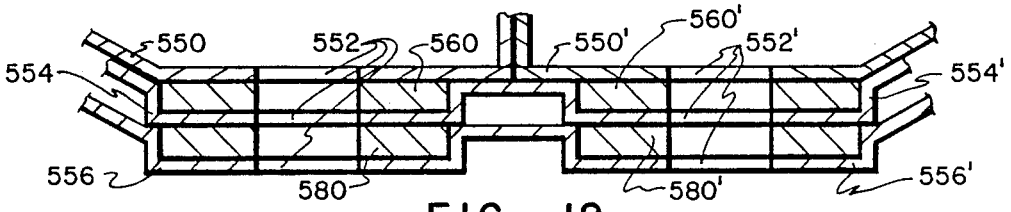
FIG. 12 is a detailed sectional view as seen substantially from a plane indicated by a line 12—12 in FIG. 10.
Figure 11:
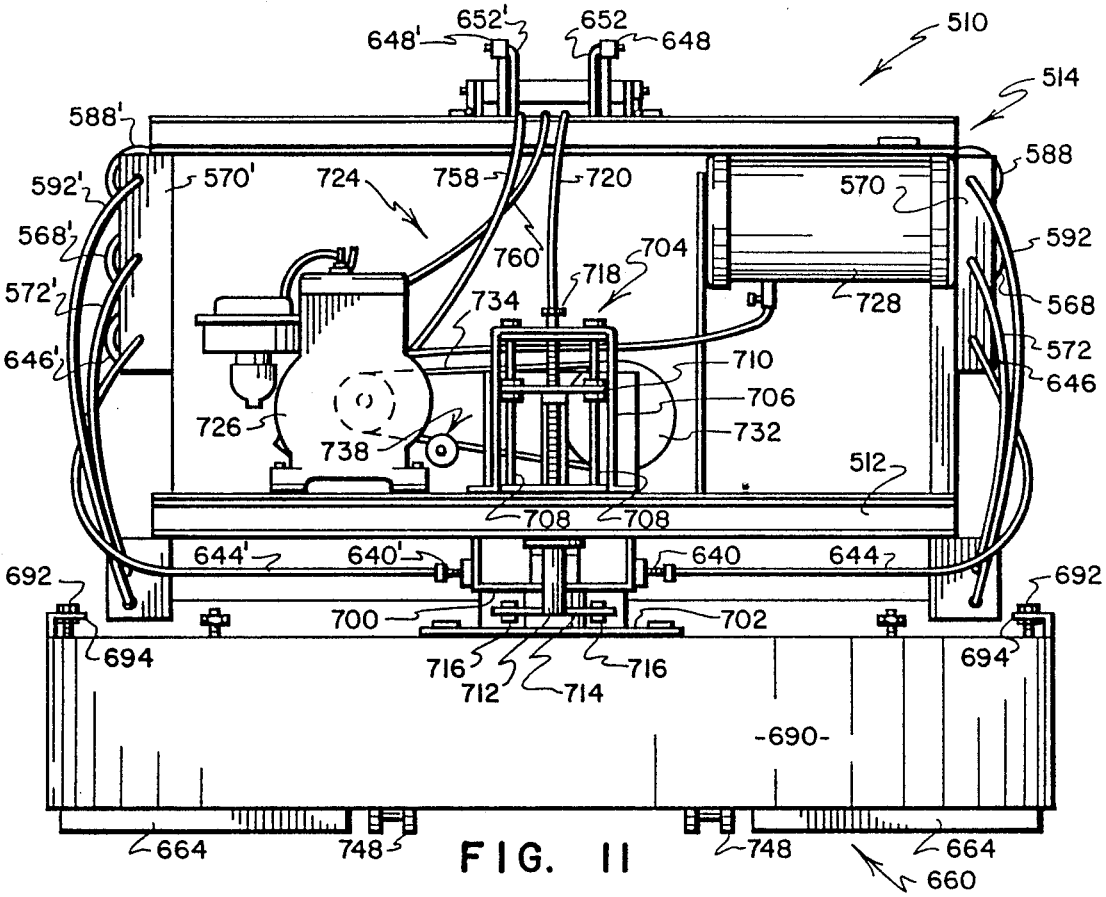
FIG. 11 is an end elevational view of the machine as viewed from the left in FIG. 7.

A valve mechanism, generally indicated at 558 in FIG. 10, comprises a slide 560 (FIG. 12) which is carried by the track 554, and which has openings matching the ports 552, the slide 560 can be shifted between open and closed positions to start and stop the flow of material from ports 552 as desired. Referring to FIG. 10, movement of the slide is effected by means of a short rack 562 on the slide which meshes with a pinion 564 rotatable in a housing 566 at one side of the machine. Rotation of the pinion is manually controlled by a handwheel 568 mounted on a control panel 570 at one side of the machine near the operator's handle 528. A rotary drive cable 572 (FIG. 7) is connected at one end to the shaft of the hand wheel 568, and at its other end to the shaft of the pinion 564. Thus, by rotating the hand wheel 568 in one direction or the other, the operator can open or close the ports 552 associated with the hopper 550 at will.

The means for controlling the dispensing of particulate material from the hopper 550 also includes a metering control, generally indicated at 578 in FIG. 10, which can be set to restrict the effective size of the ports 552 to any desired degree. The mechanism is generally similar to the valving mechanism just described, and includes a slide 580 carried in the track 556, a rack 582, a pinion 584 mounted in the housing 566, and is operated by a handwheel 588 on the control panel 570 which is connected to the pinion 584 by a rotary drive cable 592. Thus the operator can determine a desired setting to give the proper proportions to the resulting mix, which setting will not be disturbed by any necessity for temporarily discontinuing the flow of material from hopper 550 by means of the valve mechanism 558.

The other hopper 550' is essentially like the hopper 550 and the dispensing controls are essentially the same and are indicated by the same reference numerals as those used in connection with the hopper 550, but primed. It will be understood, of course, that the housing 566', a control panel 570' and the associated elements are mounted on the opposite side of he machine from the corresponding elements relating to the hopper 550.

The cables 592, 592' are provided with digital indicators (not shown) to provide a clear indication of the sizes of the dispensing port openings.

As can be seen from FIG 7 there is preferably provided a shield plate 598 attached at its ends to depending frame elements of the superstructure 514 and extending from one side to the other of the machine 510. This shield will avoid the possibility of any interference with the wheels 522 and 526 or their brake mechanisms by the particulate material being dispensed from the hoppers 550 and 550'. The shield is omitted in FIG. 10 to avoid unnecessarily complicating the view.

Mounted on the frame 512 adjacent the hopper 550 are side-by-side tanks 600, 600' for holding supplies of liquid coating ingredients. The tank 600 and the dispensing mechanisms associated therewith will be described in detail. The upper end of the tank 600 is closed by a corner of the tank bottom which is near the center line of the machine 510, and preferably at the lowest point in the bottom there is formed a discharge port surrounded and defined by a depending nipple 606, FIGS. 7 and 13. The upper end of a flexible resilient conduit 608 is clamped to the nipple 606, and its lower end is clamped to the upstanding neck 510 of a tubular dispensing manifold 612 which extends horizontally in opposite directions from the neck 510 to each side of the machine 510. The manifold 612 has a row of downwardly opening ports 614, from which the liquid in tank 600 can be dispensed upon the traffic surface. The distal ends of the manifold are preferably supported from the frame 512 by suitable support hangers (not shown).

Figure 13:
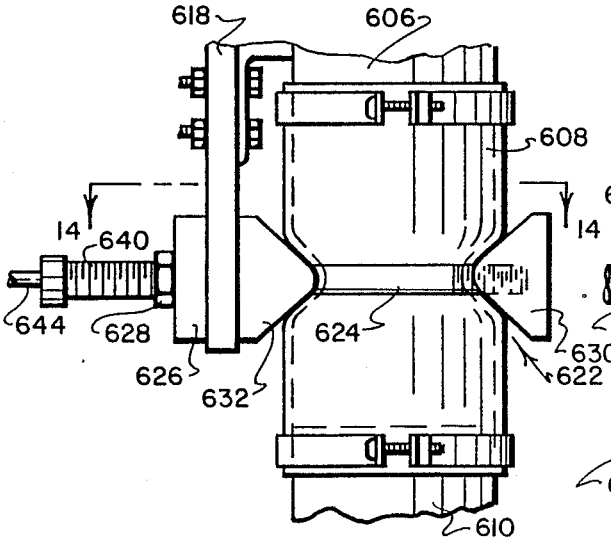
FIG. 13 is a detail elevational view of a metering mechanism for controlling flow from a liquid ingredient tank.
Figure 14:
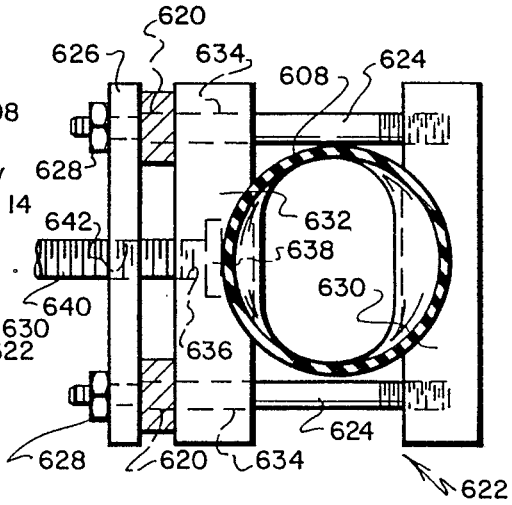
FIG. 14 is a detail sectional view as seen substantially from a plane indicated by a line 14—14 in FIG. 13.

In order to meter the flow of liquid from the tank 600, there is provided a means for pinching or constricting the resilient conduit 608 shown in detail in FIGS. 13 and 14. Support hangers 618 are affixed to and depend from the frame 512 and are drilled at 620, 620 (FIG. 14) to accept guide rods 624, 624 with a free sliding fit. A floating clamp assembly 622 is mounted in the openings 620, 620 and supported by the hangers 518, 618. The clamp assembly includes the above-mentioned guide rods 624, 624 which are each shouldered and threaded at one end. A base bar 626 has openings at each end which receive the reduced ends of the guide bars 624 and are clamped against the shoulders of the guide bars by nuts 628, 628. The other ends of the guide bars 624 are fixedly associated with a pinch member 630 as by a threaded connection, thus forming a rigid frame consisting of the members 624, 624, 626, 628, 628 and 630. Slidable on this frame is another pinch bar 632 which has openings 634, 634 loosely receiving the rods 624, 624 and a central slot 636 for trappingly and rotatably accepting the enlarged end 638 of a drive screw 640. The drive screw 640 is threadedly mounted in a central threaded bore 642 of the base bar 626, so that rotation of the drive screw 640 in one direction or the other causes the pinch members 630 and 632 to be moved towards or away from each other, thus controlling the cross sectional area of the passage through the resilient conduit 608.

A flexible rotary drive cable 644 connects the drive screw 640 with a handwheel 646 on the control panel 570.

In order to provide an instantaneous shut off for the flow of liquid from the tank 60, a control lever 648 is pivoted at 650 on a frame member at the top of the superstructure 514. The lever 648 is connected with a vertically reciprocable shaft 652 which is slidable through an opening in the top of the tank 600 and through a guide 656 mounted on an interior wall of the tank 600. The bottom end of the shaft is connected with a plug 658 which is positioned to seat in the discharge opening at the nipple 606. The operator, by manipulating the lever 648 can thus start and stop the liquid flow of the liquid material when required. The lever 648 is preferably provided with suitable detent, (not shown) to assist in retaining it at its fully open and fully closed positions.

The other tank 600' is essentially like the tank 600 and the dispensing controls are essentially the same and are indicated, wherever visible, by the same reference numerals as those used in connection with the tank 600, but primed. With reference to the neck 610' of the manifold 612', it will be recognized that the neck is bent so as to offset the manifold 612' from the manifold 612 as seen in FIG. 7 in order to eliminate interference during deposit of the tank contents when the machine is operating.

The cables 644, 644' are provided with digital indicators (not shown) to provide the operator with a clear indication of the status of pinch valve closures.

Figure 9:
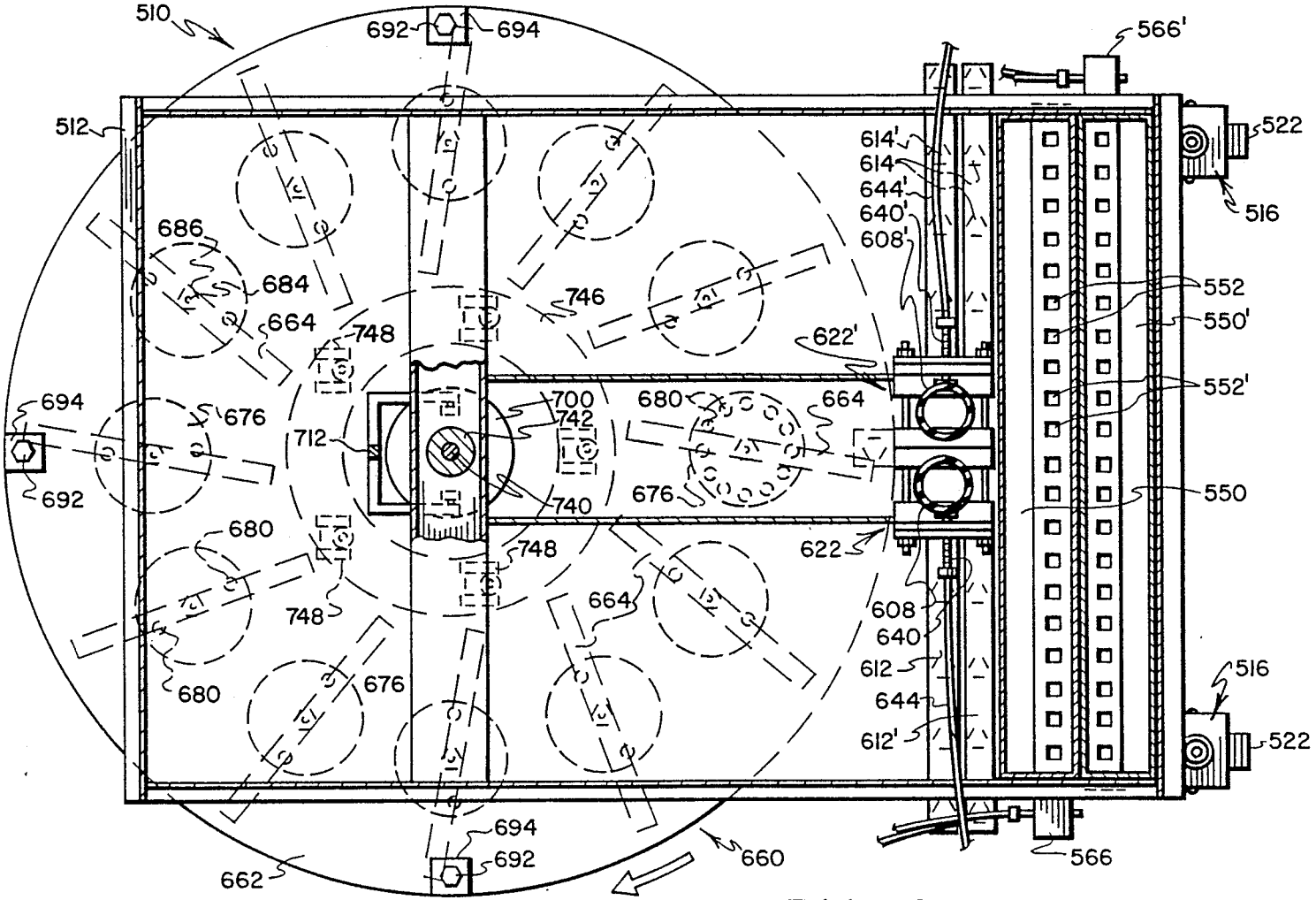
FIG. 9 is a sectional view as seen from a plane indicated by a line 9—9 in FIG. 7.

As can be seen in FIGS. 7 and 9, ingredients are deposited in bands of material extending the width of the frame 512, and the bands are clustered in a relatively confined area so that, when mixed together by subsequent operations to be presently described, the resulting mixture will exhibit a high degree of uniformity in the proportions of the ingredients, except as variations are intentionally introduced by operator control.

3. MIXING OF THE INGREDIENTS TO FORM A COATING COMPOSITION, AND APPLYING TO THE COATING COMPOSITION A SURFACE FINISH

After the ingredients of the desired mixture have been deposited on the traffic surface to be coated, the trailing end of the machine passes over and provides a mixing and finishing tool which not only stirs and mixes the ingredients thoroughly, but also spreads and/or trowels the resulting coatings in any of various selected ways under operator control to produce the desired surface finish appropriate to the nature of the traffic surface and its usage, and to the particular requirements of the coating composition.

The mixing and finishing tool is identified generally by the reference character 660, is perhaps best seen in FIGS. 7 and 9, and comprises a rotating disk 662. Depending from the disk around its periphery are a plurality of mixing and spreading members which may be of various types, but for most uses these preferably take the for of blades of flexible material such as natural or synthetic rubber, and are each indicated in the drawing by the reference character 664. It will be noted that the showing in FIG. 7 includes only two such blades 664 in order to avoid confusion, but there are preferably a significant number of such blades, for example 12, as seen in FIG. 9. Each blade 664 has a thicker spine 666 at its upper edge which is received and fastened in a yoke 668 which has the form of a channel. The blade 644 is pivotally mounted in the yoke 668 at 670 in such a manner as to allow some overhead clearance permitting the blade 664 to rock slightly about the pivot 670, allowing the blade 664 to accomodate itself to irregularities in the traffic surface. Also, the yoke is integral with a stem 672 which is received in a sleeve 674. The stem and sleeve mesh in a fashion preventing relative rotation, as by splining, for example. The sleeve 674 is integral with a plate 676 which is clamped to the disk 662 by bolts 678 associated with the plate 676 and passing through openings 680 in the disk. Within the sleeve 674 between the upper end of the stem 672 and the disk 662 is a compression spring 682 which acts to urge the blade 664 against the traffic surface and allows it to retract bodily and independently of the other blades if surface irregularities should make this necessary. A screw 684 projects from the upper end of the stem 672, passes freely through an opening 686 in the disk 662, and has a nut or other enlargement 688 acting as a stop to prevent escape of the stem 672 from the sleeve 672 whenever the disk 662 is lifted high enough to allow the blades 664 to clear the traffic surface.

Referring to FIG. 9, it will be noted that there is shown a pair of small circles that are associated with most of the plates 676. These represent somewhat diagrammatically the location of the mounting holes 680 for the plate 676 on the disk 662 to provide the blade angles shown. In actuality a preferred form is represented by the plate 676 in the rightmost position in FIG. 9 wherein the disk 662 is provided with a larger number of holes 680, for each blade location which would allow each blade to be placed in any of many angular positions about its vertical axis. The drawing should be understood as having omitted the repetitive showing of these many openings for convenience and clarity, and that such an arrangement for each of the blades 644 is contemplated.

The mixing and finishing tool 660 also includes about its periphery and depending from the plate 662, a cylindrical shield 690 which helps to confine any splatter or spray resulting from the mixing operation, and provides a guard against accidental injury to persons from the rotating blades, or to the blades themselves from encounter with foreign bodies which might be accidentally brought into contact with them.

The shield is preferably mounted on the disk by adjusting support screw 692 which each has its head mounted in rotatably trapped relationship to an opening in a bent over ear 694 on the shield 690 and which is threaded in a corresponding tapped boss 696 integral with the disk 662. This permits the shield to be slightly adjusted to permit it to be positioned as closely to the traffic surface as possible, depending upon the elevation at which the tool is being operated, since the tool is capable of vertical adjustment as will presently appear.

Firmly attached to the top central surface of the disk 662 of the too 660 is a hub 698 with an upper flange 700 and a lower flange 702. Cooperating with the flanges of the hub 698 is an elevator mechanism indicated generally at 704 which can be used by the operator to place the tool at the desired elevation for mixing and finishing under various circumstances of operation, or for raising the tool clear of the traffic surface when not operating.

The elevator mechanism 704 comprises a subframe 706 mounted on the upper surface of the frame 512. The subframe comprises four vertical guide shafts, each designated 708. Slidingly associated with the guide shafts is a platform 710 arranged for up and down movement. The platform 710 has an integral depending arm 712 which passes through an opening in the deck of the frame 512 and is rigidly connected with a horizontal form 714, each arm of which has at its tip a roller 616. The form arms and the rollers and are so located that they enter between the flanges 700 and 702 whereby the rollers 716, 716 will encounter one flange or the other as they move up and down with the platform 710.

A vertical drive screw 718 is centrally mounted and is journaled near its opposite ends and prevented from moving axially by the subframe 706. The screw 718 is threadedly connected with the platform 710 for lowering and raising motion thereof as the drive screw 718 is rotated. The upper end of the drive screw 718 is connected with a flexible rotating drive cable 720 which, at its other end is connected with a hand wheel 722 located at the upper center of the machine near the operator's handle 528.

4. MEANS FOR DRIVING THE MIXING AND FINISHING TOOL, AND FOR SUPPORTING THE FRAME

Figure 8:
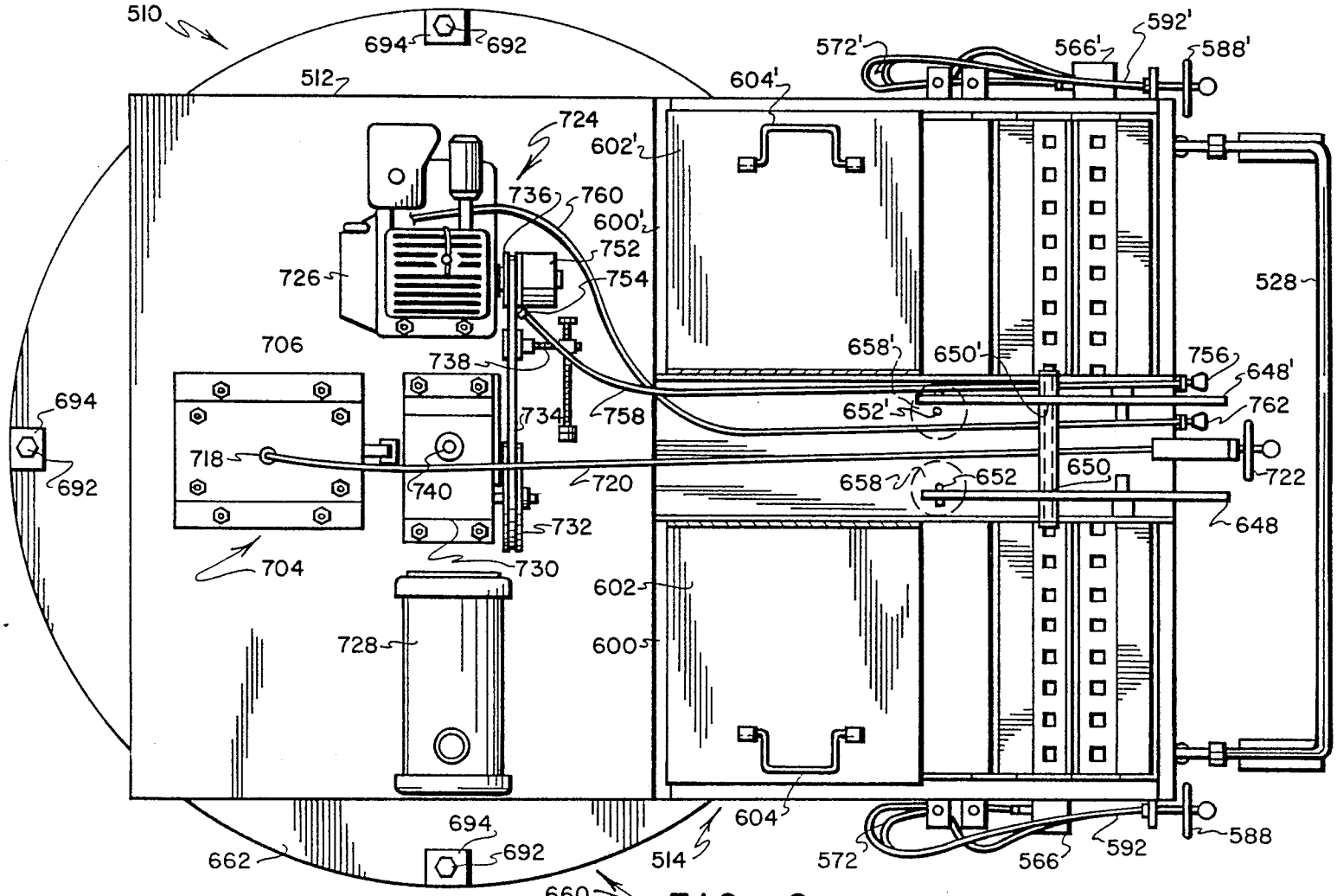
FIG. 8 is a top plan view of the machine of FIG. 7.

A power drive assembly 724 is mounted upon the upper surface of the frame 512 and includes a power source such as the internal combustion engine 726 and fuel tank 728, and speed reduction gearing 730 as seen in FIGS. 7 and 8. The gearing 730 is arranged on the longitudinal centerline of the frame 512 and has an input pulley 732 driven by a belt 734 from an output pulley 736 of the engine 726. A suitable adjustable belt tightener 738 is provided for accommodating slack which may develop as the belt 734 stretches with use.

The output shaft of the reduction gearing 730 is designated 740 and extends downwardly through the deck of the frame 512 where it passes through a combined sleeve and thrust bearing 742. The shaft continues downwardly to a point close to the traffic surface where it passes through another sleeve and thrust bearing 744 which is centered upon and integral with a circular spreader plate 746 supported on the traffic surface by a plurality of casters 748 (in this case five) to form a carriage 749. The casters 748 are preferably resiliently connected through elastomeric shock mounts (not shown) to the plate 746.

Between the two bearings 742 and 744 and surrounding the shaft 740 is a thrust sleeve 750 which transmits forces between the bearings 742, 744. The sleeve 750 receives from the upper thrust bearing 742 the load due to the weight of the machine, and transmits this load, via the lower thrust bearing 744 to the carriage 749 and thence to the traffic surface. While the carriage 749 and the lower end of the shaft 740 are normally held in assembled relationship by the weight of the machine, there is preferably a retainer such as snap ring 751 to retain the carriage on the slat in case the machine 510 is bodily raised for any reason.

The sleeve 750 is not only a thrust sleeve but also a driving member for transmitting rotation to the tool 660. It is accordingly internally keyed to the shaft 740, and its exterior exhibits splines which mesh with corresponding splines on the interior of the hub 698. It is thus possible for the assembled shaft 740 and sleeve 750 to support the weight of the machine via the carriage 749 while at the same time acting as the rotary drive for the tool 660. This drive is also effective in various raised and lowered positions of the tool 660 due to the splined connection of the sleeve 750 and the hub 698, and the capability of the elevator mechanism 704 to control tool position during its rotation is made possible by the cooperation of the rollers on the fork 714 with the flanges 700 and 702 of the hub 698.

The elevator mechanism 704 can be used to st the level of the tool 660 in four distinct ranges. First, when the control wheel is turned to place the platform 710 in the uppermost position, it raises the tool 660 to a position where the blades are clear of the traffic surface to allow moving of the machine from place to place. Secondly, the platform 710 can be so adjusted that is supports most of the tool weight, but allows the blades 664 to wipe lightly over the coated surface, thirdly, the platform can be lowered until the rollers 716 of the fork 714 are free of both flanges 700 and 702, as seen in FIG. 7, in which case the tool 660 rests with its own weight upon the blades 664 which strongly wipe the surface being coated as the tool 660 is rotated. Fourthly, if the platform 710 is lowered sufficiently, the weight of the left hand end (FIG. 7) of the machine can be progressively applied to the tool 706 through flange 702, causing the blades 774 to deflect and produce a trowelling effect of desired force which is limited, of course, by the maximum effect of the machine weight just as the casters 748 of carriage 749 are about to lose contact with the traffic surface.

With regard to the controls on tool rotation, it will be noted that the power can be connected or disconnected from the tool 660 to start or stop its rotation by a clutch 752 at the output shaft of the engine. A clutch control lever 754 is connected by a bowden wire 758 with a control knob 756 adjacent the operator's handle 528. The speed with which the tool 660 is rotated is controlled by the throttle of engine 726 which is connected by a bowden wire 760 with a throttle control knob 762 adjacent the operator's handle 528.

5. OPERATION

The operator first asses the traffic surface to be treated, and then charges the hoppers 550, 550' and tanks 600, 600' with the separate ingredients needed to make up the coating composition of the general type which will be required for the job at hand, or at least for the particular coating problem immediately presented in case the nature of the condition indicates that plural superimposed coating treatments of significantly varying types will be needed All ingredients in the containers may not be required for the general coating procedure, but certain ones will perhaps be included for use intermittently to treat special local problems of the surface whenever encountered.

With the hopper on-off valve mechanisms 558, 558' and the on-off plugs 658 and 658' of the tanks 600 and 600' set in "off" or non-flow positions, the operator adjusts the hopper metering controls 578, 578' by means of hand wheels 588, 588' and the floating clamp metering controls 622, 622' of the tanks by means of handwheels 646, 646' to permit the proper flow under operating conditions such that the proportions of the resulting mixture, when formed on the traffic surface, will be correct. These settings will normally have been previously determined by calculation confirmed by test runs, and provided in tables for the operator's guidance.

Assuming merely a relatively straight elongate surface to be coated, the operator would start the engine 726 and pull the machine 510 into initial position by the handle 528. He would then open such of the valves 558, 558' by means of handwheels 568, 568', and such of the plugs 658, 658' by means of levers 658, 658' as control the containers whose ingredients will be needed for the ingredients of the basic coating about to be applied. At the same time he will operate the handwheel 722 to present the blades 664 of the tool 660 to the traffic surface with the degree of contact indicated for the type of treatment and consistency of coating being provided.

As he starts to move the machine 510 by its handle 528 in a direction to the right as seen in FIG. 7, the operator engages the clutch 752 by means of the control knob 756 to start rotation of the tool 660, and adjusts the speed of rotation by the throttle control knob to give the prescribed speed of tool rotation for the job at hand, usually in the vicinity of 45 to 80 RPM.

Just after the various containers deposit portions of their contents on the traffic surface in correct proportions for the final mix, the tool 660 passes progressively over these deposits and thoroughly mixes the ingredients to form the desired coating material. Several features of the mechanism contribute to this mixing action. First the large number of blades and their relatively rapid movement contribute to efficient stirring. Secondly it will be noted that the direction of movement of the ingredients is periodically altered by the design of the tool. The blades 664 are normally set at a slight angle to the radius of the tool so that coating material has a slight vector in a rearward direction as the lead blades sweep over it, and in a forward direction as the trailing blades encounter it. In addition, for situations calling for more active stirring, the blades may be set in different angular positions prior to the run by releasing the fasteners 678, turning the plates 676 through the desired angle and then attach them to the disk 662 using a different set of mounting openings 680, 680. Frequently the blades are so set that they make alternate positive and negative angles with their radii so that the direction of movement of the mix along the blade edge will be very rapidly alternated as the blades pass a particular spot.

In some instances the ingredients are of a character such that even more intensive mixing is required. In such a case the machine 510 may be caused to traverse a short length of traffic surface with the dispensing orifices open, then the shut-off devices (e.g., valves 558 and 558' and plugs 658 and 658') can be operated to stop the flow. Thereafter the tool 660 can be dropped to operative position by the elevator mechanism 704 via handwheel 722 and caused to traverse the length of traffic surface back and forth for several or even many passes until the operator recognizes the degree of mixing as satisfactory.

The finishing treatments required for different surfaces vary depending upon the coating material being used, the type of surface to which it is being applied, and the desired degree of smoothness or roughness of the finished surface. As previously described these differences may all be accommodated by the height at which the tool 660 is set, from a very light touch to a high pressure sweep with the blades 664 being deflected so that portions of their side faces lie against the coating and provide a pronounced trowelling action. In some cases the mixing and finishing can both be achieved with a single blade setting. If the circumstances do not permit this, however, it will be understood that when the mixing is completed with the tool height appropriate for that function, the operator can cut off the ingredient flow using valves 558, 558' and plugs 658, 658', can then reset the tool 660 via the elevator mechanism 704 to a height suitable for finishing, and then treat the coated traffic surface with the tool 660 alone.

As the coating proceeds, the operator may reach locations in the traffic surface where special problems have been previously identified, and at such point the mix may be altered by adding special ingredients for this particular location by opening one or more additional valves 668, 668' or plugs 658, 658' temporarily to alter the condition of the mix without permanently affecting it, and as soon as the special treatment is complete, the mix can be restored to its original proportions by merely closing the valve or plug which was temporarily opened.

When the traffic surface is a small or odd-shaped area, the machine of the invention has special applicability. The machine can be readily manipulated by the operator into and out of corners, cul-de-sacs and the like. For example, the machine may be propelled up to an edge of the traffic surface and stopped. Then, by reason of the swivelable nature of the wheels 522 and 526, its frame 512 can be turned about the axis of the tool 660, an the next sweep of the tool can occur at any desired angle (e.g., 90 degrees) to the original approach. In addition, the operator can readily guide the tool 660 in sharply curved sweeps by applying the brake 530 to wheel 522 using the actuating lever 526, or the brake 530' to the frame 512 about the braked swivel wheel as a center.

DISCLOSURE OF THE REFERENCED PARENT CASE

Figure 15:
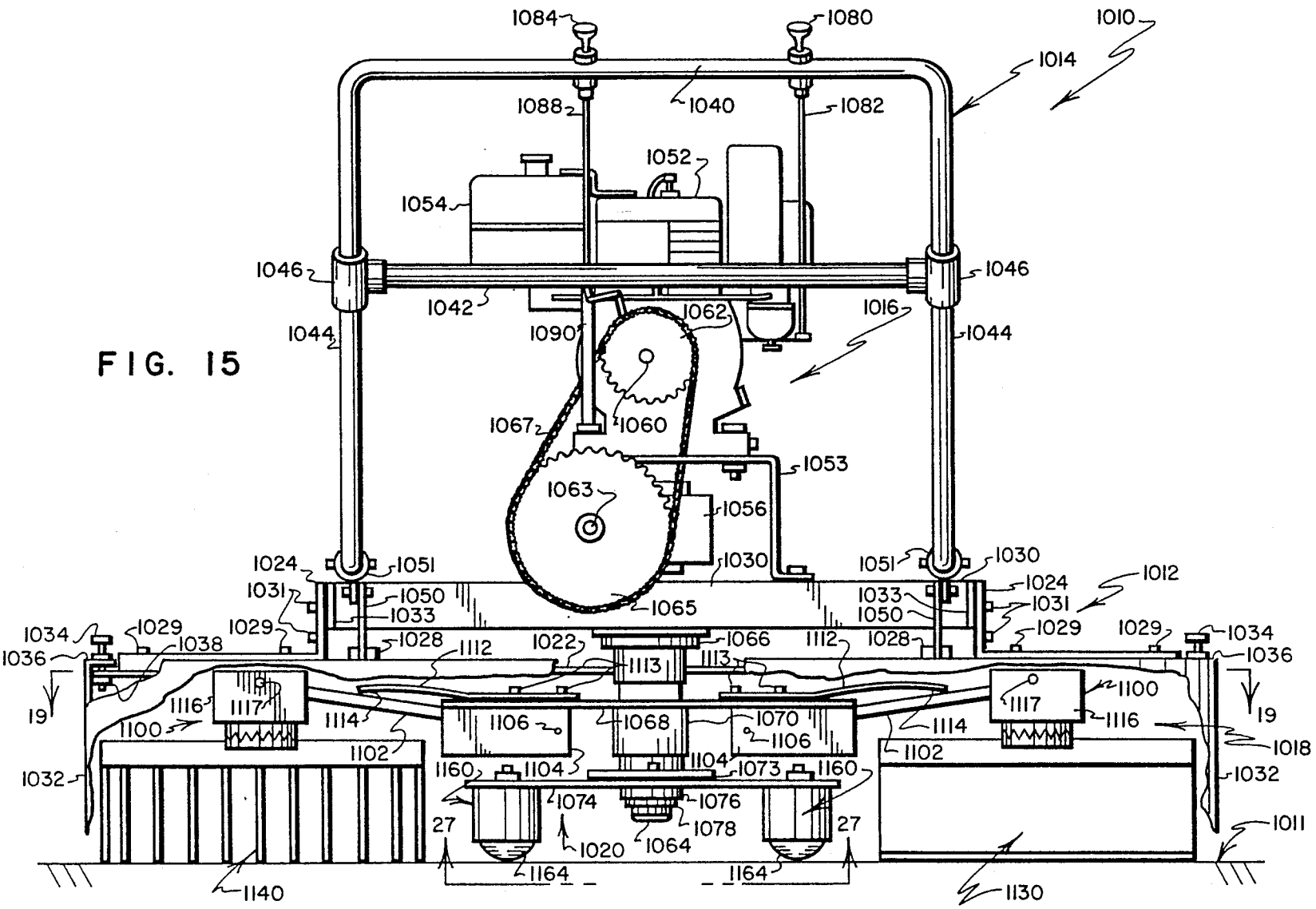
FIG. 15 is a front end elevational view of a finishing apparatus embodying the preferred practice of the invention of the referenced Parent Case, with portions broken away to permit underlying structures to be viewed, as seen from an operator's platform.
Figures 16, 17:
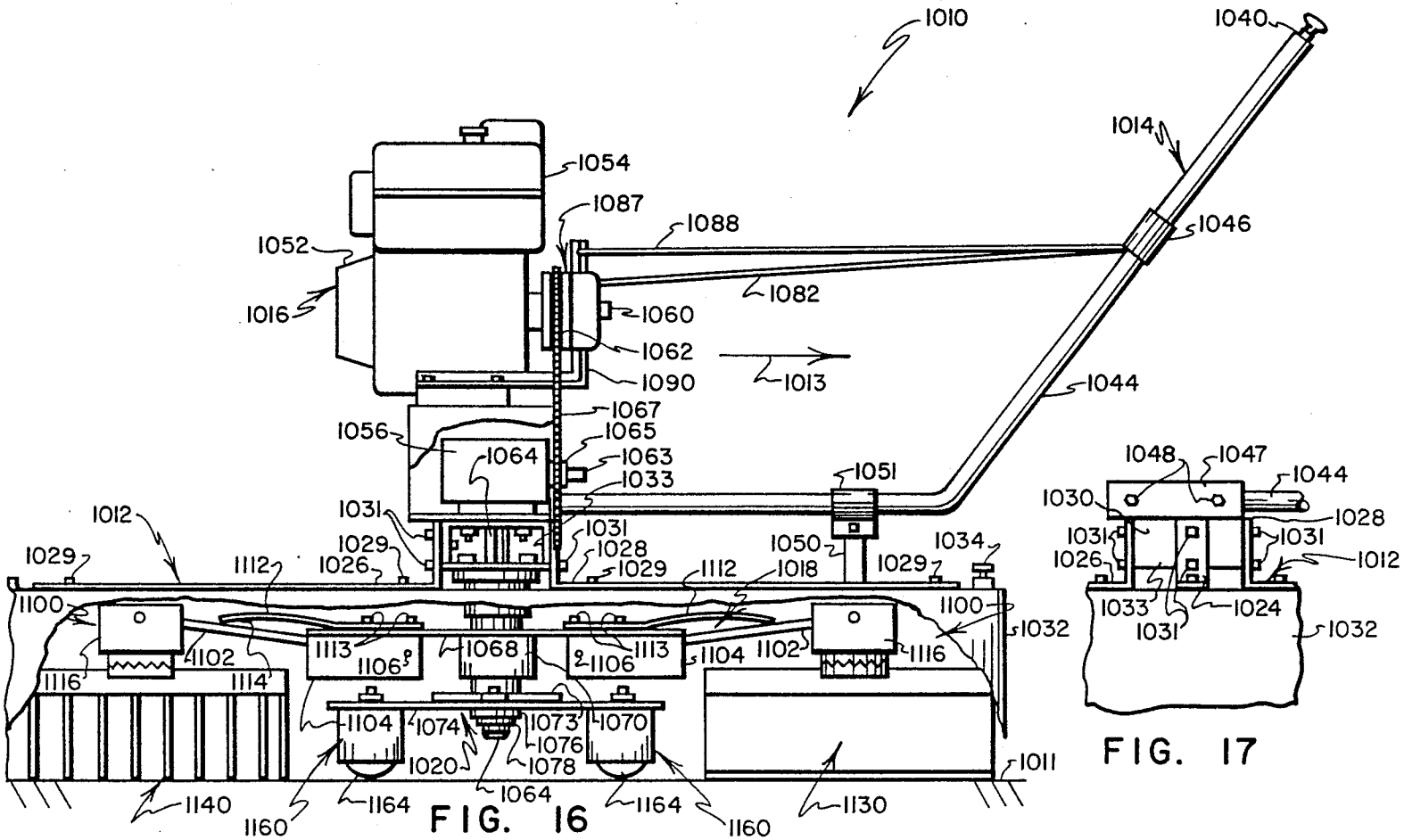
FIG. 16 is a side elevational view of the apparatus of FIG. 16, with portions broken away.
FIG. 17 is a side elevational view of portions of the apparatus, parts of which are broken away in the view of FIG. 16.

Referring to FIGS. 15, 16 and 17, an apparatus for mixing and applying coating substances to traffic surface (in accordance with the preferred practice of the invention of the referenced Parent Case) is indicated generally by the numeral 1010. In FIGS. 15 and 16 the machine 1010 is shown positioned on a traffic surface 1011. The machine 1010 includes a frame which is indicated generally by the numeral 1012, a U-shaped handle 1014, a power drive unit 1016, a mixing and finishing assembly 1018 (best seen in FIGS. 15, 16 and 18), and a central support carriage 1020 (best seen in FIGS. 15, 16 and 28). While the finishing assembly 1018 is described as embodied in the machine 1010, it may also be utilized in the aforedescribed system of the referenced Grandparent Case.

The machine 1010 is intended to be moved over the traffic surface 1011 by an operator who manually maneuvers the machine 1010 by applying force to the U-shaped handle 1014. As the machine 1010 moves over the surface 1011, it mixes, distributes and effects application to the surface 1011 of such coating substances as have been manually or otherwise deposited on the surface 1011. While a forward path of travel for the machine is indicated in FIGS. 16 and 18 by the numeral 1013, it will be understood by those skilled in the art that the machine 1010 may be moved about on the surface 1011 in substantially any horizontally-oriented direction. Accordingly, the designation of a "forward" travel path is simply for purposes of facilitating reference to various machine components by describing their orientation relative to the designated travel path, and should not be constructed as limiting the scope of the invention.

As will be explained, the central support carriage 1020 and tools 1100 which form part of the assembly 1018 engage the surface 1011 and cooperate to support the frame 1012 during operation of the machine 1010. The frame 1012, in turn, mounts, interconnects and supports many of the components of the machine 1010.

The frame 1012 includes an assembly of a circular cover or deck 1022, three pairs of L-shaped brackets 1024, 1026, 1028, a channel-shaped structural frame member 1030 and a cylindrical shield or shirt 1032. The L-shaped brackets 1024, 1026, 1028 each have horizontally extending legs which are connected to the deck 1022 by threaded fasteners 1029, and upstanding legs which are connected by threaded fasteners 1031 to a depending end and side flange portion 1033 of the structural frame member 1030.

Referring to FIGS. 15 and 16, the brackets 1024 are fastened to the cover or deck 1022 in spaced relation along an imaginary line of diameter extending transversely relative to the forward travel path 1013. Referring to FIGS. 16 and 18, the brackets 1026 are fastened to the deck 1022 at locations extending rearwardly across the deck 1022 with respect to the direction of the forward travel path 1013. The brackets 1028 are fastened to the deck 1022 at locations aligned with the brackets 1026 but extending forwardly across the deck 1022 with respect to the direction of the forward travel path 1013.

The cylindrical skirt 1032 is attached to and depends from the deck 1022. The skirt 1032 extends perimetrically about the mixing and finishing assembly 1018 and helps to confine any splatter or spray resulting from the operation of the machine 1010, and provides a guard against accidental injury to persons who might otherwise inadvertently come into contact with the rotating finishing assembly 1018. The skirt 1032 has a perimetrically extending, inwardly turned top flange 1036 which overlies peripheral portions of the deck 1022. The flange 1036 strenghtens and rigidifies the skirt 1032, and carries adjustable fasteners 1034 at spaced locations along its circumference which are arranged to permit the skirt 1032 to be elevated or lowered relative to the plane of the deck 1022 so that the bottom edge of the skirt 1032 may be positioned as desirably close to the traffic surface 1011 as is practical, taking into account the irregularities and contours of the particular traffic surface being treated.

The apparatus control handle 1014 is of tubular, generally U-shaped construction having a pair of leg portions 1044 which are interconnected by an integrally formed grippable cross member portion 1040. A reinforcing cross member 1042 also interconnects the legs 1044 and is connected thereto by couplings 1046. Ends of the legs 1044 extend into sleeve-type couplings 1047 carried on the frame member 1030. Bolts 1048 secure the legs to the couplings 1047.

The handle 1014 extends forwardly from the assembly 1018 so that an operator walking ahead of the machine 1010 along the forward travel path 1013 can manually guide and move the machine 1010. While the machine 1010 is most easily described by utilizing such directional terms as "forward" and "rearward," it will be understood that the machine 1010 may be moved in any chosen direction across the surface 1011. Accordingly, the use of such directional terms as "forward" and "rearward" should not be deemed to be limiting.

Referring again to FIGS. 15 and 16, the power drive unit 1016 is mounted atop the frame member 1030 at a location which is substantially central to the machine 1010 to maintain proper machine balance. The power drive unit 1016 includes a power source such as an internal combustion engine 1052, a fuel tank 1054, and a gear reducer 1056. The engine 1052 is mounted over the gear reducer 1056 on a bracket 1053. Referring to FIG. 16, the engine 1052 has an output shaft 1053. Referring to FIG. 16, the engine 1052 has an output shaft 1060 that carries a clutch assembly 1087 which drivingly connects the shaft 1060 with a drive sprocket 1062. The gear reducer 1056 has an input shaft 1063 which carries an input sprocket 1065. A chain 1967 is reeved around the sprockets 1962, 1065 to drive the input shaft 1064 from the output shaft 1060.

Referring to FIGS. 159 and 16, the gear reducer 1056 is bolted to the frame member 1030 and drives an output shaft, designated by the numeral 1064, which extends upwardly into and drivingly connects with a hollow-bore output sleeve (not shown) of the gear reducer 1056. The shaft 1064 depends substantially vertically through a hole (not shown) that is formed substantially centrally through the deck 1022. The shaft 1064 extends through a thrust bearing assembly 1066 that is connected to the frame member 1030. The shaft 1064 extends through a thrust bearing assembly 1066 that is connected to the frame member 1030. The shaft 1064 has a shoulder (not shown) that engages the thrust bearing 1066 to enable the weight of the deck 1022 and such other components as are supported by the frame member 1030 and by the deck 1022 to be imposed on the shaft 1064. Since the bearing 1066 is spaced downwardly from the gear reducer 1056, the engagements made by the shaft 1064 with the gear reducer 1056 and with the bearing 1066 are at spaced positions along the length of the shaft 1064, whereby a sturdy supporting connection is established between the shaft 1064 and the relatively heavy load that is carried by the shaft 1064. The shaft 1064 continues downwardly through a tool support disk 1068 and through a sleeve 1070 which is rigidly connected to the disk 1068. The sleeve 1070 is keyed to the shaft 1064 so that the sleeve 1070 and the shaft 1064 are caused to rotate in unison. The shaft 1064 continues downwardly through a thrust bearing assembly 1073 and through a bearing 1076 which are connected to an annular support plate 1074. The shaft 1064 has a radially extending shoulder (not shown) which makes a tarnsition to a relatively small diameter end portion of the shaft 1064, and it is this shoulder that is engaged by the thrust bearing assembly 1073 so that the shaft 1064 and the weight load that is carried by the shaft 1064 are transmitted by the thrust bearing assembly 1073 to the support plate 1074 and the thrust bearing assembly 1073 in place relative to the shaft 1064.

Referring to FIG. 15, the speed of the rotating shaft 1064 is controlled by a throttle lever (not shown) carried on the engine 1052. The throttle is manually operated by a throttle control knob 1080 which is movably supported by the handle 1014. The throttle control knob 1080 is connected to the engine-carried throttle by a flexible control cable 1082 which extends from the control knob 1080 through a hold formed in the cross member 1042. In a like manner a clutch control knob 1084 is supported by the handle 1014 and is connected to a clutch operating lever (not shown) by a flexible control cable 1088 through a support bracket 1090. The engine-carried clutch 1087 serves to drivingly engage and disengage the engine 1052 from the gear reducer 1056.

Referring to FIG. 19, the finishing assembly 1018 includes the central disk 1068 and a plurality of radially extending tools 1100. As previously described, the disk 1068 is connected to the drive shaft 1064 to effect rotary movement of the tools 1100.

Figure 21:
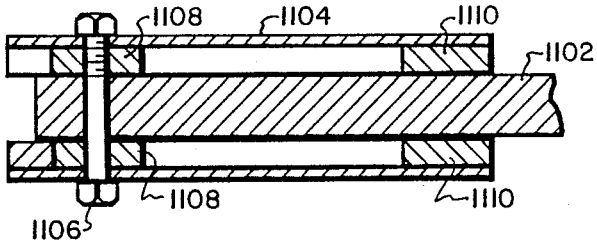

Referring to FIG. 15, one of the arms 1102 which connects a tool 1100 to the disk 1068 is shown. The arm 1102 is pivotally connected by a bolt 1106 to a rectangular bracket 1104 which depends from the central disk 1068. Referring to FIG. 21, a pair of flat washers 1108 are disposed between opposed inner surface portions of the bracket 1104 and opposed sides of the arm 1102. A pair of bearing guide plates 1110 are carried by the bracket 1104 in the vicinity where the arm 1102 extends outwardly from the bracket 1102. THe washers 1108 and the guide plates 1110 serve to confine the arm 1102 to pivotal movements about the axis of the bolt 1106, and enable the arm 1102 to move the tool 1100 vertically so that the tool 1100 may be maintained in contact with the traffic surface 1011 despite variations and irregularities in the surface 1011.

Referring to FIG. 16, the tools 1100 are biased toward the traffic surface 1011 by leaf springs 1112 which are fastened to the disk 1068 by a pair of bolts 1113. The bolts 1113 also serve to connect the brackets 1104 to the disk 1068. Each of the leaf springs has a distal end 1114 which rests atop a separate one of the arms 1102.

Figure 20:
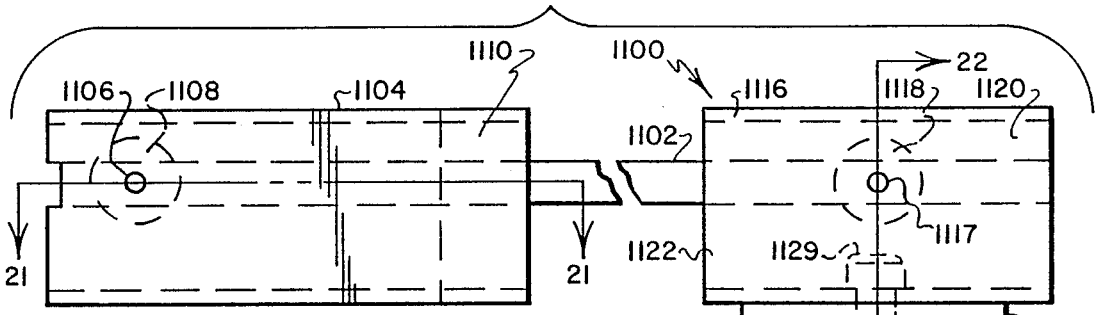
FIG. 20 is an enlarged, foreshortened side elevational view of one embodiment of a spreading tool utilized in the apparatus of FIG. 15.
Figure 22:
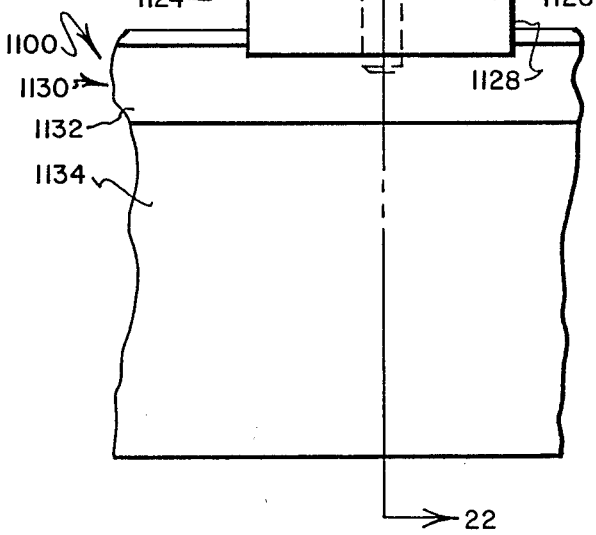
FIGS. 21 and 22 are sectional views as seen from planes indicated by the lines 21—21 and 22—22, respectively, in FIG. 20.
Figure 22:
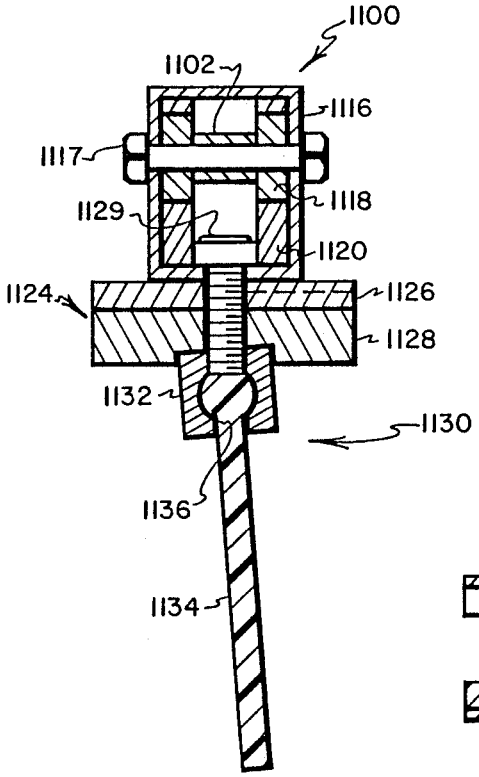

Referring to FIGS. 20 and 22, the tool 1100 is pivotally connected by a bolt 1117 to an outer end portion of the arm 1102 by a rectangular bracket 1116 which is similar to the bracket 1104. A pair of bearing washers 1118 are disposed between opposed sides of the arm 1102 and opposed inner side walls of the bracket 1116 to insure that the bracket 1116 is allowed to pivot freely about the bolt 1117. Two pairs of guide bearing plates 1120, 1122 are disposed near the inner and outer ends of the bracket 1116, and engage opposed sides of the arm 1102. The pivotal attachment of the tool 1100 to the arm 1102 permits the tool 1100 to pivot about the axis of the bolt 1117 in response to engagements with irregular contours in the surface 1011.

A toothed coupling 1124 is carried by a lower portion of the bracket 1116. The coupling 1124 includes an upper half 1126 and a lower half 1128. The upper half 1126 of the coupling 1124 depends from and is rigidly connected to the bracket 1116. The lower portion of the coupling 1128 carries the tool 1100. The upper and lower halves 1126, 1128 of the coupling 1124 are clamped into engagement by a bolt 1129. The angle of attachment of the tool 1100 relative to the arm 1102 may be adjusted by loosening the bolt 1129, disengaging the coupling halves 1126, 1128, rotating the tool 1100 to the desired angle, and re-engaging the halves 1126, 1128 by tightening the bolt 1129.

Figure 26:
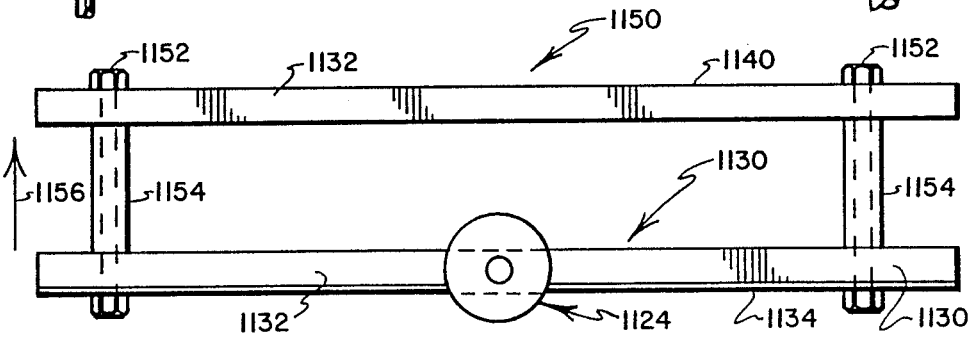
FIG. 26 is a top plan view of the tandem tool assembly of FIG. 25.
Figure 27:
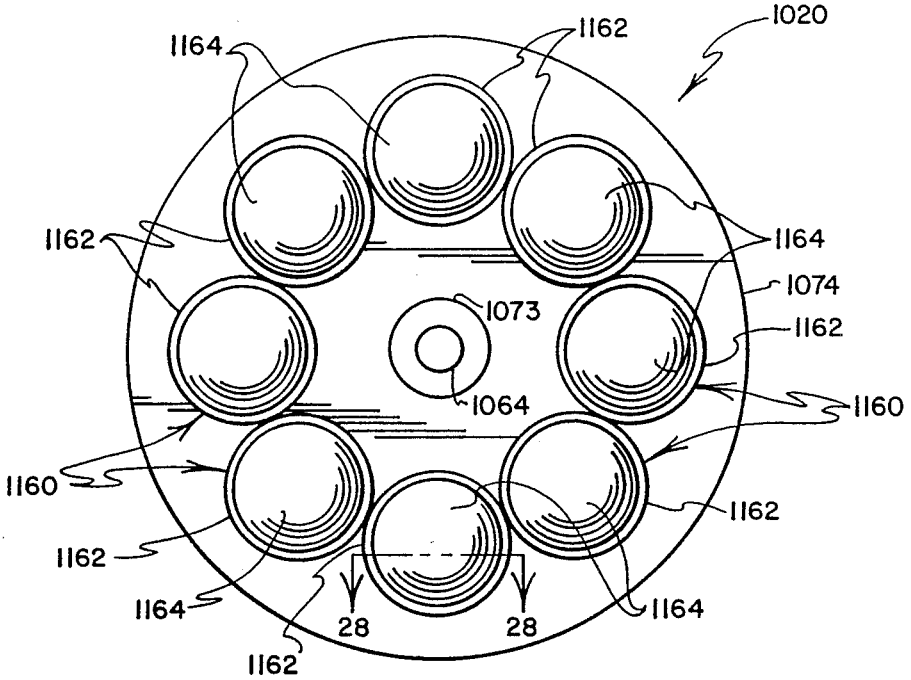
FIG. 27 is a bottom plan view of a support carriage having a plurality of ball-type wheels, as seen generally from a plane indicated by a line 27—27 in FIG. 15; and, FIG. 28 is an enlarged sectional view of a single ball-type wheel as seen from a plane indicated by a line 28—28 in FIG. 27.

The tool 1100 may take either of two preferred forms: it may comprise a single blade-like applicator 1130 as depicted in FIGS. 20 and 21, or it may include both a blade-like applicator 1130 and a mixing tool 140, as depicted in FIGS. 26 and 27. The finishing tool 1130 takes the form of a blade structure 1134 which is mounted in a head assembly 1132. The head assembly 1132 is connected to the lower half of the coupling 1128 by a bolt 1129 which extends through the lower portion of the bracket 1116, through the coupling 1124, through a threaded portion of the head assembly 1132, and into engagement with the blade 1134. The head assembly 1132 is preferably an extrusion of relatively rectangular outer dimension with a keyhole-shaped groove 1136 formed therein, as can best be seen in FIG. 22. The head 132 is carried by the lower coupling 1128 and extendsat an acute angle relative to the traffic surface 1011 so that the blade 1134 is inclined rearwardly relative to the direction of rotation of the tool 1100 to improve the resulting finishing effect.

Figure 23:
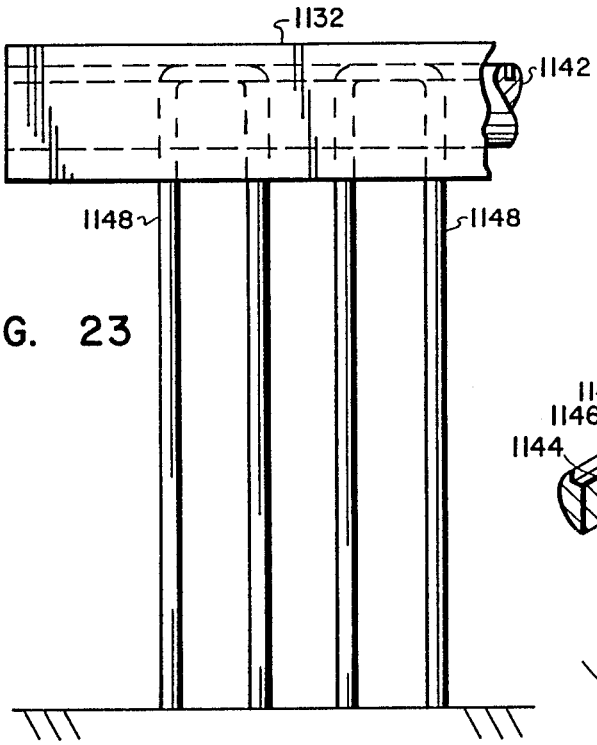
FIG. 23 is a side elevational view of an alternate form of tool for use with the apparatus of FIG. 15.
Figure 24:
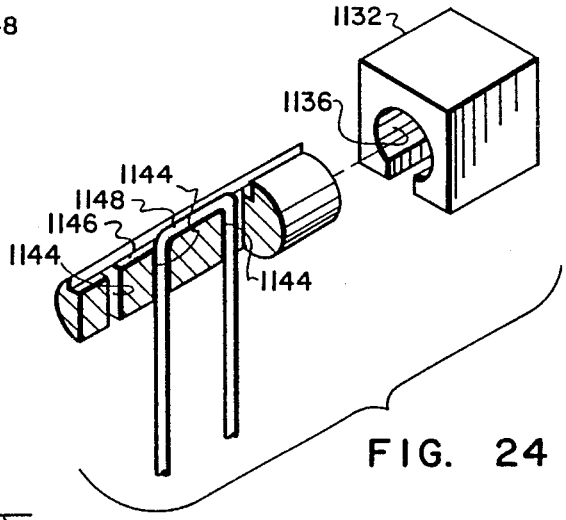
FIG. 24 is a perspective, exploded view showing selected portions of the mixing tool of FIG. 23.

Referring to FIG. 23, the mixing tool 1140 is shown. The tool 1140 serves to break up large particulate matter which may be deposited on the traffic surface 1011 so that the tool 1130 can uniformly spread the material. The mixing tool 1140 takes the form of a mandrel 1142 which is of sufficient diameter to fit into the groove 1136 of the head 1132. A series of vertical holes 1144 are formed through the mandrel 1142, as is shown in FIG. 24. The holes 1144 are connected by a groove 1146 which is formed along the upper surface of the mandrel 1142. The mixing tool 1140 is formed by inserting U-shaped tines 1148 through adjacent pairs of the holes 1144 with the top portion of the U-shaped tines 1148 being recessed in the grooves 1146. The grooves 1146 are of sufficient depth so that the top portion of the tines 1148 are flush with the outer surface of the mandrel 1142 to permit the assembly of the mandrel 1142 and the tines 1148 to be inserted into the head 1132. The tines 1148 are of sufficient length to allow them to be dragged along the surface 1011 to effect a mixing and breaking action of the coating materials deposted on the traffic surface 1011.

In preferred practice, the mixing tools 1140 and the spreading tools 1130 are used together on the machine 1010, and are arranged so that tools 1130 alternate with the tools 1140 on adjacent arms 1102. Other arrays of the tools 1130, 1140 are also within the purview of the present invention, as will be understood by those skilled in the art.

Figure 25:
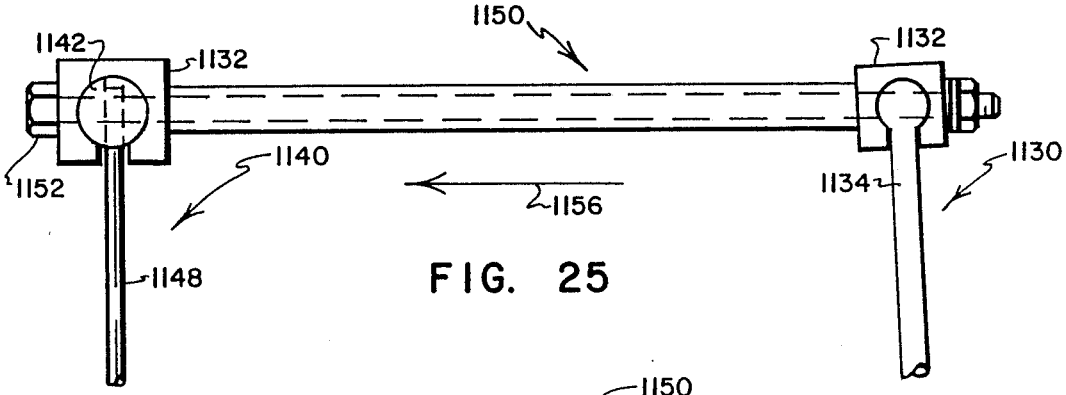
FIG. 25 is an end elevational view of still another alternate tool assembly embodiment alternative which includes a spreading tool and a mixing tool mounted in tandem.

Referring to FIGS. 25 and 26, still another alternate embodiment 1150 of the tool 1100 is shown. In the embodiment 1150, the spreading tool 1130 and mixing tool 1140 are connected and held in spaced parallel relationship by a pair of bolts 1152 which extend through the head assemblies 1132 of each of the tools 1130, 1140 to form a combined tool 1150. A pair of sleeves 1154 are provided between the tools 1130, 1140 to keep them in spaced, parallel relationship. Where the tool embodiment 1150 is employed, the spreading tool 1130 is connected to the splined couplings 1124 and is carried by the bracket 1116. The mixing tools 1140 are arranged to precede the spreading tools 1130 with respect to the direction of rotation of the finishing assembly 18, as is indicated in FIGS. 25 and 26 by the arrow 1156.

Referring to FIGS. 15, 16 and 27, the carriage 20 includes the circular support plate 1174 and a plurality of ball wheels 1160. In the machine 1010, a total of eight wheels 1160 are preferably used. The circular support disk 1174 is preferably formed of a somewhat flexible metal material so that the support plate 1174 may itself act as a shock absorber as the machine 1010 is moved across the traffic surface 1011. The carriage 1020 serves to support the weight of the machine 1010 by rotatably receiving the drive shaft 1064 in the thrust bearing 1063 as previously described.

Figure 28:
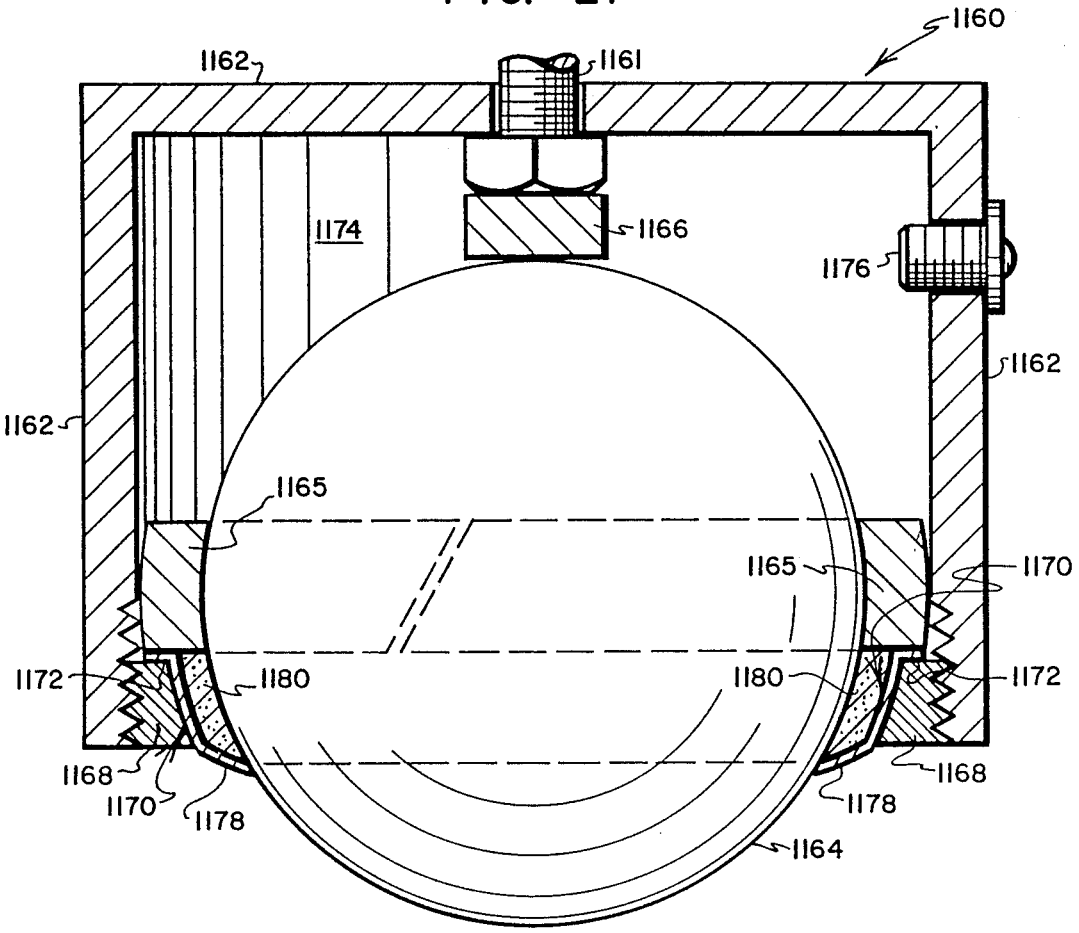

Referring to FIG. 28, one of the ball wheels 1160 is shown. The ball wheel 1160 includes a cylindrical, downwardly opening housing 1162 and a ball 1164. The housing 1160 is attached to the plate 1074 by a bolt 1161. The ball 1164 is partially encased in the housing 1160 and is kept spaced apart from the inside walls of the housing 1160 by a split coupling bearing 1165 and a thrust bearing pad 1166. The split coupling bearing 1165 encircles a midsectional portion of the ball 1164 and allows the ball 1164 to move freely within the housing 1162. The thrust pad bearing 1166 is connected to the bolt 1161 and serves to allow the ball 1164 to rotate without touching the upper wall of the housing 1162.

The ball 1164 is secured int he housing 1162 by a threaded locking ring 1168. The ring 1168 threadably engages the lower, inner portion of the housing 1162 and underlies the bearing 1165. An annular collar 1170 lines inwardly facing surfaces of the locking ring 1168 and is specially configured from spring material to provide an outwardly turned flange 1172 which overlies the upper end of the locking ring 1168, and a depending, inwardly turned lip 1178 which extends below the locking ring 1168 and closely surrounds the ball 1164. The lip 1178 of the collar 1170 serves to remove particulate matter from the surface of the ball 1164 as the ball 1164 rotates. Carried internally of the collar 1170 is an inner band 1180 of material which carries a lubricant and serves to assist the lip 1178 in removing small particulate matter from the surface of the ball 1164. As the thrust pad 1166 wears from use, the locking ring 1168 may be tightened to compensate for wear and to assure that the ball 1164 is securely retained in the housing 1162.

A chamber 1174 is defined within the housing 1162. In preferred practice, the chamber 1164 is at least partially filled with a lubricant such as grease to keep the surface of the ball 1164 lubricated and to impede the attachment of particulate matter to the ball 1164. A plug 1176 is provided in an opening formed through the housing 1162 to enable the chamber 1164 to be charged with lubricant.

The ball wheels 1160 render the finishing machine 1010 highly maneuverable, and give it a capability to change direction readily. The lubricated surfaces of the ball wheels 1160, the cleaning action of the lip 1178, and the operation of the band 1170 keep the ball wheels 1160 free from contaminants and permit them to rotate freely as the machine 1010 is moved across the traffic surface 1011.

DISCLOSURE OF THE PRESENT INVENTION

Figure 2:
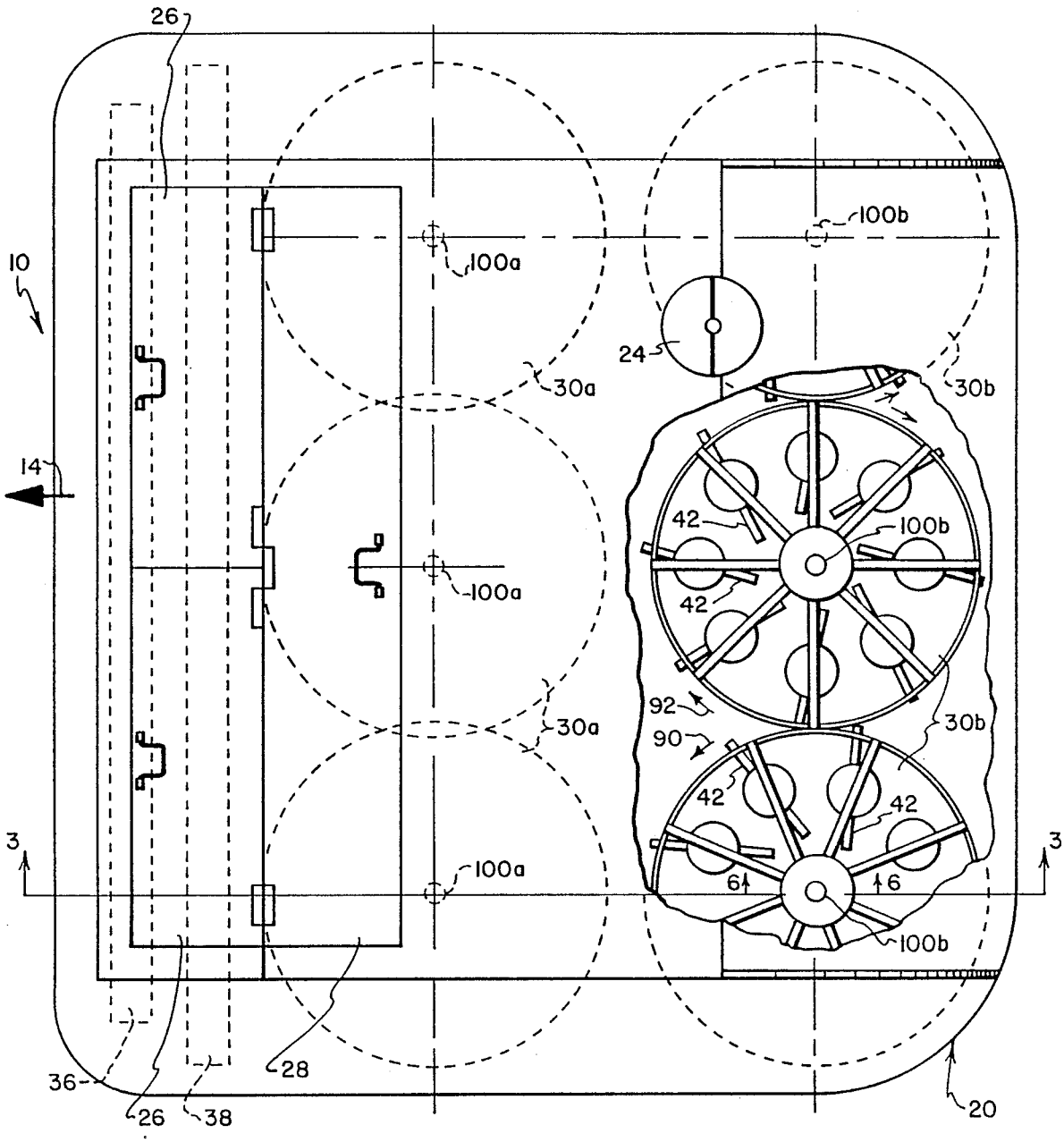
FIG. 2 a top plan view thereof with portions broken away to permit finishing assembly features to be seen.
Figure 3:
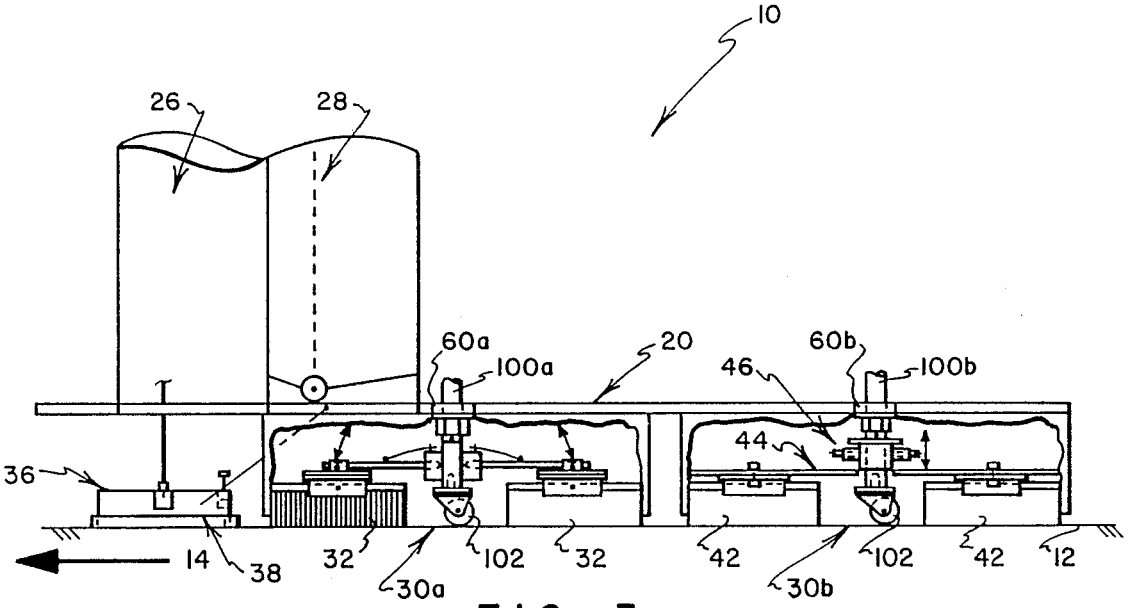
FIG. 3 is a sectional view as seen from a plane indicated by a line 3—3 in FIG. 2.

Referring to FIGS. 1, 2 and 3, one preferred form of apparatus for mixing and applying coating constituents to traffic surfaces is indicated generally by the numeral 10. In FIG. 3 the machine 10 is shown positioned on a traffic surface 12. A forward direction of movement for the apparatus 10 is indicated by an arrow 14

Figure 5:
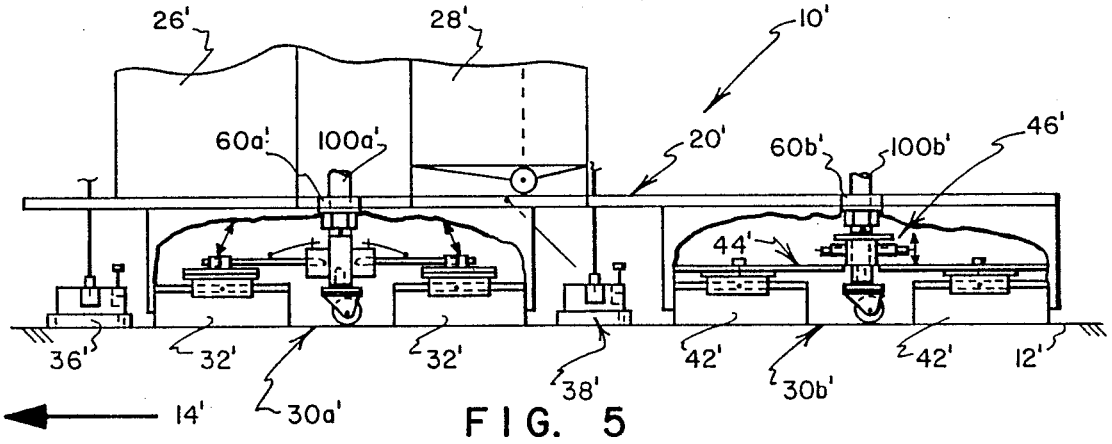
Figure 4:
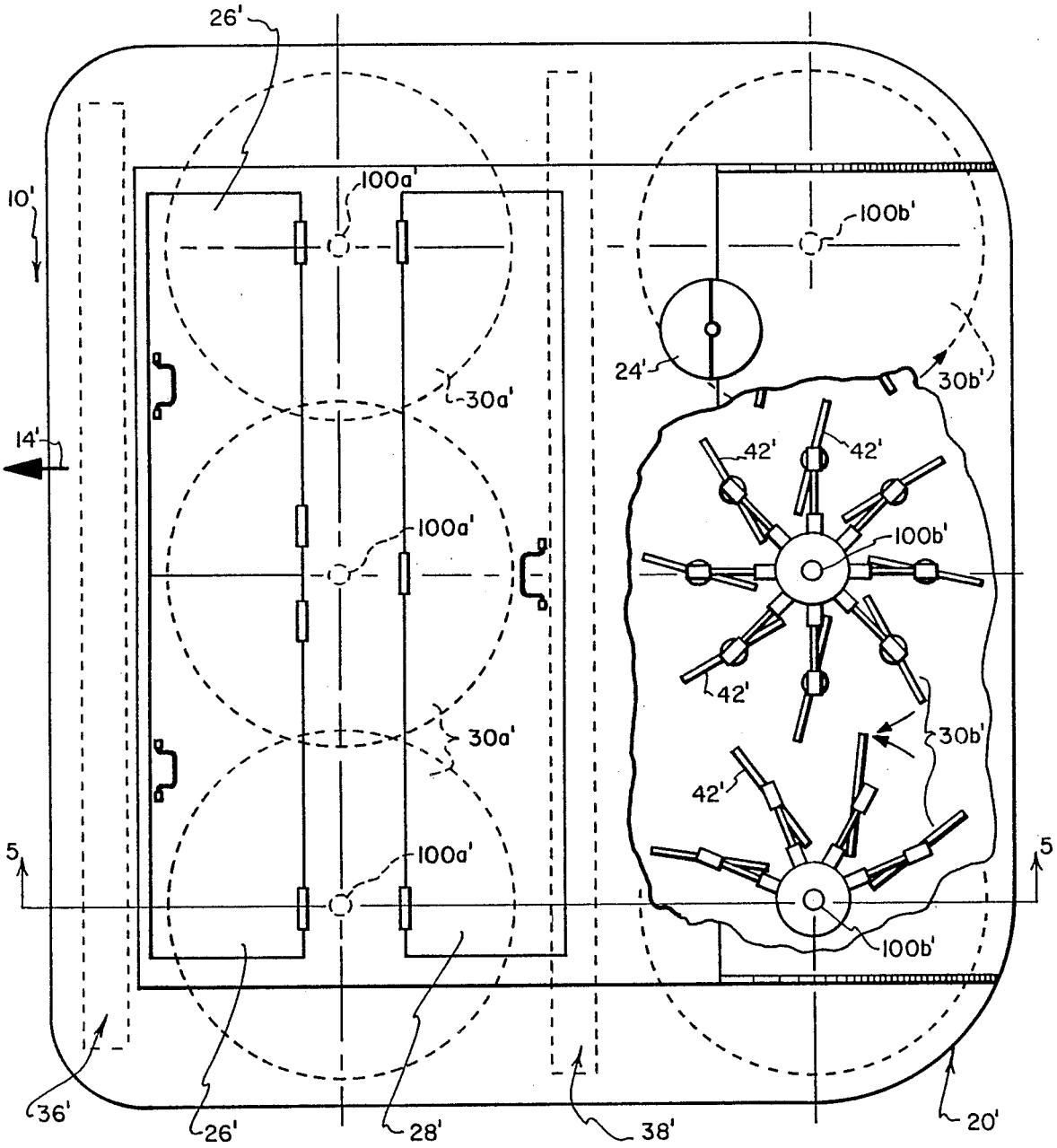
FIG. 4 a top plan view similar to FIG. 2 showing an alternate form of surface finishing apparatus that embodies features of the present invention; plane indicated by "line 5—5 in FIG. 4.

Referring to FIGS. 4 and 5, an alternate preferred form of apparatus for mixing and applying coating constituents to traffic surfaces is indicated generally by the numeral 10'. A forward direction of movement for the apparatus 10' is indicated by an arrow 14'.

The apparatus 10 differs from the apparatus 10' primarily in that the relative spacing and arrangement of the operating components that effect dispensing, mixing, and application of coating constituents to traffic surfaces Since the basic character of the dispensing, mixing, and application components of the apparatus 10 and those of the apparatus 10' are substantially the same, corresponding components of the apparatus 10 and the apparatus 10' are indicated by identical numerals, except that the numerals used with the apparatus 10' are followed by a "prime" mark. Features of the apparatus 10 will be described with the understanding that the same description is applicable to the features of the apparatus 10' unless stated to the contrary.

Because the system of the present invention preferably utilizes apparatus features that are described and illustrated in the referenced Parent and Grandparent Cases, the full disclosures of which are incorporated herein by reference, the need is obviated to describe in detail many of the features of the apparatus 10 and the apparatus 10'.

The apparatus 10 includes a frame or carriage assembly which is indicated generally by the numeral 20. While the apparatus 10 is depicted as including an operator platform 22 and operator controls 24 that are used to effect self-propelled operation of the apparatus 10, it will be understood by those skilled in the art that the apparatus 10 can be powered either by a conventional engine (not shown) that typically is supported on and housed within the structure of the carriage 20, or the apparatus 10 may be towed or carried by a conventional vehicle such as a truck or tractor (not shown). If the apparatus 10 is to be towed or carried by a powered vehicle such as a truck or tractor, power to operate the dispensing, mixing and applicator components of the apparatus 10 may be derived from the power supply of the towing or supporting vehicle, or from an engine (not shown) that typically is housed by the carriage 20.

As the apparatus 10 is moved over a traffic surface 12 in a forward direction 14, the apparatus 10 mixes in situ and effects application to the traffic surface 12 of coating constituents that have been dispensed from separate forward and rearward storage compartments 26, 28 that are carried on the frame or carriage 20. As will be readily understood by those skilled in the art, the storage compartments 26, 28 may take any of a wide variety of conventional forms such as liquid-containing tanks or particulate-containing bins that occupy portions of the carriage 20. Alternatively, the storage compartments 26, 28 may comprise bins, tanks or the like that are carried by a towing or supporting vehicle (not shown).

Such apparatus as is used to effect dispensing of coating constituents from the storage compartments 26, 28 can comprise any of a wide variety of conventional, commercially available dispensing devices, including but not limited to nozzle-carrying sprayer bars for dispensing low viscosity liquids metering type dispensing units for dispensing particulates, distributor boxes for dispensing liquids and/or particulates, and the like. Moreover, such dispensing systems as are described in the referenced Grandparent Case can, for example, be used with the apparatus 10. In this regard, reference is made to the foregoing sub-section entitled "2. Storing and Dispensing of Individual Ingredients," and to the drawing FIGURES that are referred to therein.

In accordance with one feature of the present invention, a plurality of rotary applicator units or finishing assemblies of the general type indicated by numerals 30*a* and 30*b* (see FIGS. 2 and 3) are carried by the frame or carriage assembly 20 for mixing in situ and applying to a traffic surface 12 such coating constituents as have been dispensed from the compartments 26, 28 at locations beneath the frame 20 that are designated by numerals 36, 38, respectively. The finishing units 30*a* are located forwardly relative to the finishing units 30*b*. Each of the forward finishing assemblies 30*a* has a vertically extending drive shaft 100*a* that extends through carriage 20. Each a bearing 60*a* that is connected to the of the rearward finishing assemblies 30*b* has a vertically extending drive shaft 100*b* that extends through a bearing 60*b* that is connected to the carriage 20.

Referring to FIGS. 3 and 5 wherein differences between the apparatus 10 and the apparatus 10' are most easily compared, it will be seen that the apparatus 10 has its dispensing locations 36, 38 clustered forwardly with respect to the forward and rearward finishing assemblies 30*a* , 30*b* . In contrast, the apparatus 10'has one of its dispensing locations 36 located forwardly with respect to the forward finishing assemblies 30*a'*, while the other of its dispensing locations 38 is located between the forward and rearward finishing assemblies 30*a'*, 30*b'*. The spacing between the forward and rearward drive shafts 100*a*, 100*b* in the apparatus 10 is less than the depicted spacing between the forward and rearward drive shafts 100*a'*, 100*b'* in the apparatus 10' to enable the apparatus 10' to provide for dispensing at the location 38' between the forward and rearward finishing assemblies 30*a'*, 30*b'*.

Referring to FIGS. 2 and 3, the forward and rearward finishing assemblies 30*a*, 30*b* preferably are of the general type that are described in the referenced Parent and Grandparent Cases. Each of the forward finishing assemblies 30*a* is depicted as being identical to a finishing assembly (referred to above by the reference numeral 1018) that is described and depicted in FIG. 1 of the referenced Parent Case, U.S. Pat. No. 4,603,999 issued Aug. 5, 1986, except that its drive shaft 100*a* is depicted as having a single swivel wheel 102 that underlies its lower end region (as is described below in conjunction with FIG. 6) rather than a carriage that mounts a plurality of swivel wheels (as is described in the referenced Parent Case). Each of the rearward finishing assemblies 30*b* is depicted as being identical to a finishing assembly (referred to above by the reference numeral 660) that is described and depicted in the referenced Grandparent Case, U.S. Pat. No. 4,477,203 issued Oct. 16, 1984, except that a single swivel wheel 102 underlies its lower end region (as is described below in conjunction with a discussion of FIG. 6).

While the finishing assemblies 30*a* have arms 34 that are arranged to yieldably bias their associated finishing tools 32 into engagement with the traffic surface 12 (as is described in the referenced Parent Case), the finishing assemblies 30*b* have tools 42 that are carried on a structure 44 that can be raised or lowered to selectively position the tools 42 relative to the traffic surface 12 and to hold the tools 42 at a selected height above the traffic surface 12 by positioning a collar 46 that is slidably movable along the drive shaft 100*b* (as is described in the referenced Grandparent Case).

The forward finishing assemblies 30*a* are positioned side by side for tandem rotation to cooperatively effect a first stage of mixing and application action of coating constituents to the traffic surface 12 as the apparatus 10 is moved along a travel path in a forward direction of travel 14. Likewise, the rearward finishing assemblies 30*b* are arranged in side by side relationship for tandem rotation to cooperatively effect a second stage of mixing and application action as the apparatus 10 is moved along a travel path in a forward direction of travel 14.

In order to effect tandem cooperative rotation of the finishing assemblies 30*a*, 30*b*, a power operated drive system (not shown) is provided that preferably includes a plurality of conventional commercially available timing belts and timing belt pulleys that are utilized to rotate the drive shafts 100*a*, 100*b* about their vertically extending center axes from a common output shaft (not shown) of an engine that typically is carried by and housed within the carriage 20. However, any conventional form of drive system may be used that will effect a coordinated and cooperative rotation of the finishing assemblies 30*a*, 30*b* (preferably with adjacent ones of the side by side finishing assemblies being driven in opposite directions of rotation and at identical speeds of rotation). Those skilled in the art will readily understand that the power operated drive systems shown and described in the referenced Parent and Grandparent Cases may be adapted in accordance with conventional practice to incorporate timing belt drives that connect with a plurality of the drive shafts 100*a*, 100*b* to effect the desired type of tandem rotation of the finishing assemblies 30*a*, 30*b*.

The staged dispensing, staged mixing and application setup that is depicted for the apparatus 10' is in some instances more desirable for applying certain kinds of coating constituents to certain kinds of traffic surfaces, while the multiple stage mixing and application action that is achieved with the setup of the apparatus 10 is more desirable for applying other kinds of coating constituents to certain kinds of traffic surfaces. An apparatus (not shown) which combines the staged dispensing capabilities of the apparatus 10' and the staged mixing and application capabilities of the apparatus 10 can of course be provided in accordance with the practice of the present invention, as by providing dispensing systems that can selectively discharge forwardly of or between selected finishing assemblies, and/or by providing a more extensive staged array of finishing assemblies (including, for example, a center row of finishing assemblies that is interposed between the forward and rearward finishing assemblies 30*a*, 30*b*) whereby a plurality of staged dispensing, mixing and application actions can be effected as may be desired.

Figure 6:
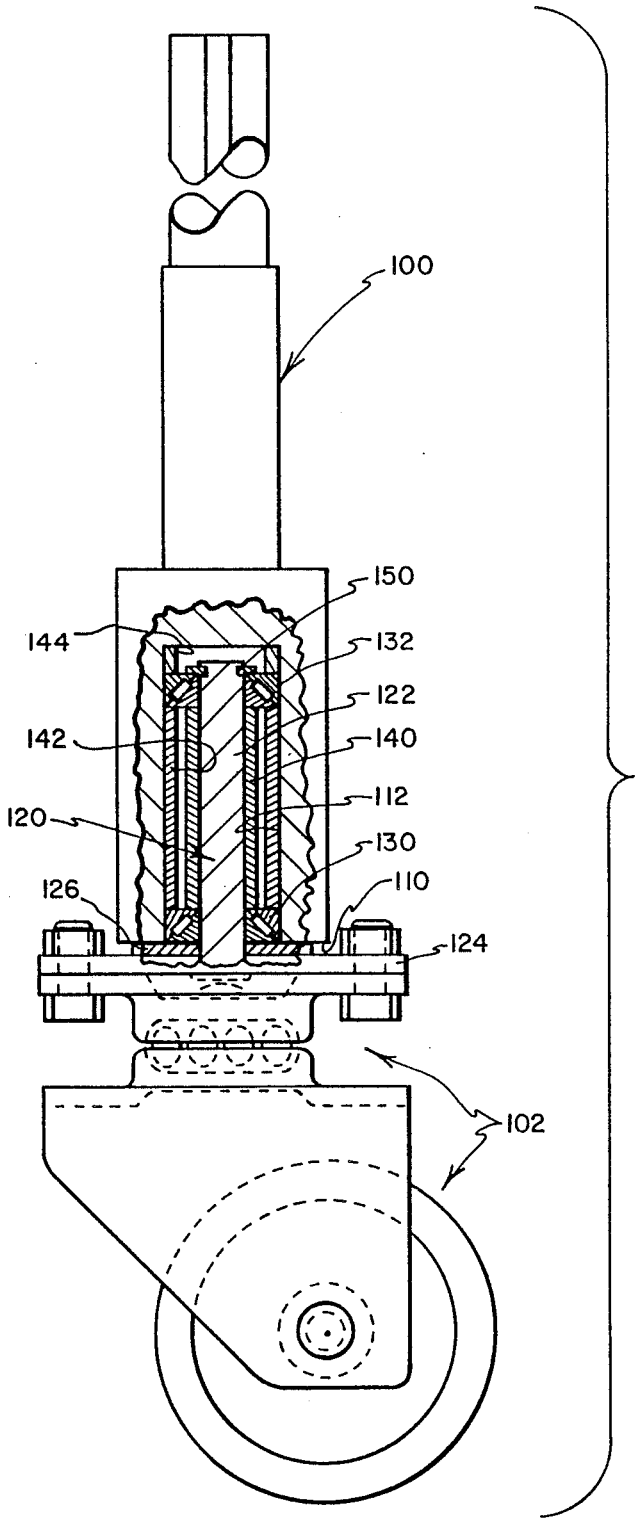
FIG. 6 is a foreshortened side elevational view on an enlarged scale of portions of the apparatus of FIG. 4, with portions thereof broken away and shown in cross section as seen from a plane indicated by a line 6—6 in FIG. 4.

Referring to FIG. 6, a preferred form of drive shaft 100*a*, 100*b* that is used to support the forward and rearward finishing assemblies 30*a*, 30*b* is indicated simply by the numeral 100. The shaft 100 is an elongate structure of stepped outer diameter that is configured to be received in one of the bearing mount 60*a*, 60*b* that is connected to the carriage 20. The shaft 100 has a lower end surface 110 that extends radially with respect to the axis of the shaft 100. An opening 112 that faces downwardly opens through the end surface 110 and extends upwardly into the shaft 100 for a distance of several inches so as to receive an upper end region 122 of a stub shaft 120.

The stub shaft 120 has a mounting plate 124 welded to its lower end region, and carries a washer-like thrust bearing 126 that closely underlies the end surface 110 of the shaft 100. A pair of spaced thrust bearings 130, 132 are carried within the opening 112 and serve to journal the upper end region 122 of the stub shaft 120 to permit relative rotation between the shafts 100, 120. A set of inner and outer bushings 140 and 142, 144, respectively, position the bearings 130, 132 at desired spaced locations along the shafts 100, 120. A snap ring 150 is carried in a groove formed in the upper end region 122 of the shaft 120 for overlying the bearing 132. By this arrangement, the bearings 130, 132 are held in position between the snap ring 150 and the thrust washer 126.

A swivel wheel assembly 102 of conventional form is bolted to the mounting plate 124 for supporting a portion of the weight of the apparatus 10 atop the traffic surface 12 as weight force is transmitted from the drive shaft 100 through the thrust bearings 130, 132 to the stub shaft 120 and thence to the swivel wheel 102. If excessive thrust force is applied to the bearings 130, 132, the closely juxtaposed positioning of the thrust washer 126 that underlies the end surface 110 of the shaft 100 will cause the thrust washer 126 to firmly engage the end surface 110 to aid the bearings 130, 132 in carrying the load.

As should now be apparent to those skilled in the art, some aspects of the present invention reside in combining features of the referenced Parent and Grandparent Cases in novel and useful ways to provide highly versatile, relatively large capacity apparatus for separately dispensing a plurality of coating ingredients onto a traffic surface, for mixing the dispensed constituents in situ, and for applying the mixed constituents to achieve desired types of coatings that protect, restore, and/or enhance the traffic surface. Other features of the present invention reside in the tandem cooperative use of rotary finishing assemblies in side-by-side and forward-rearward relationships, and in providing for the dispensing of selected components in spaced relationship along a path of travel so that a staged dispensing and/or mixing and application of coating constituents is achieved as may be most suitable for the circumstances of a particular application. Still other features of the invention reside in the swivel wheel mounting arrangement of FIG. 6 which can be used with the finishing assemblies that are described in the referenced Parent and Grandparent Cases.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of applying to a traffic surface a coating composition consisting of plural ingredients, wherein the method comprises the steps of:

(a) depositing a plurality of ingredients from a plurality of individual supply sources upon a traffic surface to be coated, with the deposits of at least selected ones of the ingredients being made in relatively close proximity to each other to facilitate the formation of a deposit mixture;

(b) bringing into contact with the deposited ingredients a plurality of rotary stirring tools, with each of the rotary stirring tools including an associated rotary structure having associated depending blades that are arranged in an array about an associated axis that extends substantially normal to the traffic surface, with the axes of the rotary stirring tool begin spaced horizontally from one another to position the rotary stirring tools in relatively close proximity to each other for rotation in tandem to cooperatively effect mixing and application of the deposited ingredients to form a coating on the traffic surface, and with at least selected ones of the rotary stirring tools each having means connecting its associated blades to its associated rotary structure so that, when the associated rotary structure and blades are rotated about the associated axis, the blades are permitted to move a limited amount relatively toward and away from the rotary structure, and to rock relative to the rotary structure about other axes that extend substantially parallel to the traffice surface;

(c) rotating the plurality of rotary stirring tools about their assocaited axes with the blades of the selected ones of the rotary stirring being urged into substantially continuous contact with the traffic surface and with the deposited ingredients to effect a a rapid mixing of the ingredients to a condition of uniform consistence; and (d) smoothing the mixed ingredients to the traffic surface by continuing rotation of the plurality of rotary stirring tools about said axes, with the blades of the selected ones of the rotary stirring tools moving relative to their movements to the contour of the traffice surface and to substantially maintain contact with the traffic surface.

2. The method of claim 1 additionally including the steps of:

(a) providing an apparatus for supporting the rotary stirring tools, with the apparatus including a power drive system for rotating the rotary stirring tools in tandem; and, (b) moving the apparatus across the traffic surface along a forward path of travel to move the rotary stirring tools across the traffic surface along the forward path of travel, with the associated axes of at least two of the rotary stirring tools being located relatively forwardly and relatively rearwardly with respect to the forward path of travel such that at least one of the rotary stirring tools is a relatively forwardly located stirring tool and at least one other of the rotary stirring tools is a relatively rearwardly located stirring tool, and whereby the forwardly located rotary stirring tool serves to mix and apply coating constituents to traffic surface portions along said path before the rearwardly located rotary stirring tool serves to further mix and apply coating constituents to the traffic surface portions along said path.

3. The method of claim 2 wherein the step of depositing ingredients from the supply sources includes the steps of applying at least one of the ingredients from the supply sources at a location along said path that is relatively forward with respect to the forwardly located stirring tool.

4. The method of claim 3 wherein the step of depositing ingredients from the supply sources additionally includes the step of applying at least one of the coating ingredients from the supply sources at a location along said path that is between said forwardly located stirring tool and said rearwardly located stirring tool.

5. The method of claim 1 additionally including the steps of:

(a) providing an apparatus for supporting the rotary stirring tools, with the apparatus including a power drive system for rotating the rotary stirring tools in tandem; and, (b) moving the apparatus across the traffic surface along a forward path of travel to move the rotary stirring tools across the traffic surface along the forward path of travel, with the associated axes of at least two of the rotary stirring tools being located relatively side by side as the apparatus moves along the travel path such that one of the rotary stirring tools is a relatively leftwardly located stirring tool and the other is a relatively rightwardly located stirring tool, and whereby the leftwardly and rightwardly located rotary stirring tools cooperate in serving to mix and apply coating constituents to traffic surface portions along said travel path.

6. The method of claim 5 wherein the step of depositing ingredients from the supply sources includes the steps of applying at least one of the ingredients from the supply sources at a location along said path that is relatively forward with respect to the leftwardly and rightwardly located stirring tools.

7. The method of claim 5 wherein the step of providing an apparatus includes the step of supporting at least selected ones of the rotary stirring tools such that their axes of rotation are located relatively rearwardly along the path of travel with respect to the side by side arrangement of the relatively leftwardly and rightwardly located rotary stirring tools, whereby the apparatus has relatively forwardly and relatively rearwardly located rotary stirring tools, and the step of rotating the rotary tools includes the step of rotating the forwardly and rearwardly located rotary stirring tools in tandem to cooperatively effect mixing and application to traffic surface portions of such coating ingredients as are deposited thereon as the apparatus moves along the travel path.

8. The method of claim 7 wherein the step of depositing ingredients from the supply sources additionally includes the step of applying at least one of the coating ingredients from the supply sources at a location along said path that is between the relatively forwardly and relatively rearwardly located rotary stirring tools.

9. The method of claim 1 wherein the step of depositing ingredients from individual supply sources includes the step of intermittently starting and stopping the deposit of at least a selected one of the ingredients to accommodate variations in the condition of the traffic surface being coated.

10. The method of claim 1 wherein the step of rotating the plurality of rotary finishing tools includes the step of adjusting the speed of tool rotation to accommodate the nature of the ingredients that are being applied to the traffic surface.

11. The method of claim 1 wherein the step of depositing a plurality of ingredients from a plurality of individual supply sources includes the steps of:

(a) progressively applying the deposits of ingredients in a path along the surface; and, (b) moving the plurality of rotary stirring tools along said path concurrently with the step of depositing the ingredients and directly subsequent to the deposit thereof.

12. The method of claim 11 wherein the step of depositing a plurality of ingredients from a plurality of individual supply sources includes the step of metering the deposition flow of said ingredients, and wherein the step of moving the plurality of rotating stirring tools includes the steps of:

(a) controlling the speed of movement of the tool along said path; and, (b) adjusting both said deposition flow and said speed of movement in relationship to each other to accommodate both the nature of the coating being applied and the nature of the surface being treated.

13. The method of claim 12 further including the step of controlling the speed of rotation of the tools and controlling the speed of movement of the tools along the path in relationship to each other to accommodate the nature of the coating being applied and the condition of the traffic surface being coated.

14. Apparatus for supplying coating compositions consisting of plural ingredients to traffic surfaces, the apparatus comprising:

(a) a frame and wheels for supporting the frame upon a traffice surface to be coated;

(b) plural supply source containers mounted on the frame, with a separate one of the containers being provided for each of the ingredients of the ultimate composition;

(c) a plurality of dispensing means with a separate one of the dispensing means being provided for each of the supply sources for depositing the corresponding ingredient directly upon the traffic surface, with at least selected ones of said dispensing means being so clustered as to deposit selected ones of the ingredients in close proximity to each other to facilitate the formation of a mixture of the selected ingredients; and, (d) applicator means for mixing the deposited ingredients on the traffice surface and applying the resulting coating composition to the traffic surface, the applicator means comprising:

(i) a plurality of rotary stirring and smoothing tools each having an associated supporting structure, associated depending blades arranged in an array that substantially radiates from an associated axis that extends normal to the traffic surface, with the axes of each said rotary stirring and smoothing tools being located in horizontally spaced relationship to position the rotary stirring and smoothing tools in relatively close proximity one to another for concurrent, tandem cooperative rotation to effect mixing and application of coating ingredients to the traffic surface, and with each of the stirring and smoothing tools further having mounting means movable connecting the associated blades to the associated supporting structure for permitting limited movements of the blades in directions extending toward and away from the traffic surface, and for permitting rocking movements of the blades about other axes that extend substantially parallel to the traffic surface;

(ii) support means for supporting the plurality of rotary stirring and smoothing tools beneath at least a portion of said frame; and, (iii) drive means for connecting with each of the rotary stirring and smoothing tools to effect concurrent, tandem cooperative rotation thereof to effect mixing and application of coating ingredients to the traffic surface.

15. The apparatus of claim 14 wherein the support means includes a plurality of wheels, and at least selected ones of the wheels are so mounted as to be swivelable with respect to the frame.

16. The apparatus of claim 14 wherein each of the dispensing means further includes means for adjustably metering the dispensing flow of the associated ingredient, and independent means for stopping or starting the flow of the associated ingredient without affecting the adjustment of the metering means.

17. The apparatus of claim 14 wherein the support means further includes means for lowering and raising selected ones of the rotary stirring and smoothing tools in order to effect one of several different types of contact between the blades and the coated surface to apply an appropriate finish surface to the coating.

18. The apparatus of claim 14 additionally including at least one separate dispensing means for dispensing an ingredient of the ultimate composition at a location spaced from the location where said plurality of dispensing means deposit ingredients in close proximity to each other.

19. The apparatus of claim 14 wherein at least two of the rotary tools have their axes oriented relatively forwardly and rearwardly with respect to a forward path of travel that is followed by the apparatus in moving over the traffic surface.

20. The apparatus of claim 14 wherein at least two of the rotary tools have their axes oriented in side by side relationship relatively to a forward path of travel that is followed by the apparatus in moving over the traffic surface.

21. Apparatus for applying coating compositions consisting of plural ingredients to traffic surfaces, comprising:

(a) a frame and wheels for supporting the frame upon a traffic surface to be coated:

(b) plural supply source containers mounted on the frame, one for each of the ingredients of the ultimate composition;

(c) a dispensing means for each of the supply sources for depositing the corresponding ingredient direclty upon the traffics surface, with at least selected ones of said dispensing means being so clustered as to deposit selected ones of the ingredients in close proximity to each other to facilitate the formation of mixture of the selected ingredients;

(d) means for mixing the dispensing ingredients on the traffice surface and finishing the surface of the coating, said means comprising:

(i) a plurality of rotary stirring and smoothing tools each having associated depending blades substantially radiating from an assocaited axis that extends substantially normal to the traffic surface, with said axes being spaced horizontally to position the rotary stirring and smoothing tools in relatively close proximity to each other so that when they are rotated, the rotary tools will cooperate to stir and apply deposited ingredients to the traffic surface;

(ii) drive means for drivingly connecting each of the rotary stirring and smoothing tools to a source of power for concurrently rotating said rotary stirring and smoothing tools in tandem cooperative relationship; and, (iii) means for supporting the rotary stirring and smoothing tools at locations that extend beneath at least portion of the frame;

(e) wherein the drive means includes a plurality of vertical drive shafts, with each of said shafts being drivingly connected to a separate one of the rotary stirring and smoothing tools; and, (f) wherein the wheels include a plurality of swivelable wheel means each having a single wheel member for supporting the frame on a traffic surface, and bearing means for connecting a single swivelable wheel means to each of selected ones of the drive shafts.

22. The apparatus of claim 21 wherein at least one of the drive shafts has a lower end region located centrally among its associated rotary tools, a downwardly facing opening is defined within the lower end region, a stub shaft extends into the downwardly facing opening, said bearing means is housed within the downwardly facing opening to journal the stub shaft to permit rotation of the drive shaft relative to the stub shaft, and at least one of the swivelable wheel means is connected to the stub shaft for supporting at least a portion of the apparatus, the weight of which is transmitted from the drive shaft through the bearing means to the stub shaft and thence to said at least one of the swivelable wheel means.

23. The apparatus of claim 22 wherein the bearing means includes at least a pair of bearings that are carried within the downwardly facing opening and that journal the stub shaft at spaced locations therealong.

24. The apparatus of claim 23 wherein the lower end region of the drive shaft defines an end surface that extends in a substantially radial plane with respect to the axis of the drive shaft, and the apparatus additionally includes thrust bearing formation means that is connected to the stub shaft for providing a surface that extends in juxtaposition with portions of the end surface to transfer thrust forces between the stub shaft and the drive shaft.

25. Apparatus for applyign coating compositions consisting of plural ingredients to traffic surfaces, the apparatus commercialism:

(a) dispensing means for individually dispensing a plurality of ingredients of a coating composition upon the traffic surface;

(b) a plurailty of rotary stirring and smoothing tool means each being connected to and movable in association with the dispensing means for stirring the coating ingredients upon the traffic surface and for applying the resulting coating to the traffice surface, with each of the rotary tool means including:

(i) separate support structure mans that is connected to the dispensing means for rotation about a separate axis that extends substantially normal to the traffic surface, with the separate axes being located in horizontally spaced relationship relative to each other to position the plurality of rotary tool means in relatively close relationship;

(ii) separate mounting means movably connecting the associated blades to the associated support structure means for permitting limited movements of the associated blades in direction extending toward and away from the traffic surface, and for extending toward and away from the traffic surface, and for permitting rocking movements of the blades about other axes that extend substantially parallel to the traffic surface;

(c) drive means for connecting the plurality of rotary tool means to a source of power for concurrently rotating the rotary tool means in tandem cooperative relationship to rotate the blades over the traffic surface; and, (d) means for raising and lowering at least selected blades of the rotary tool means and for setting the same in selected position to control the nature of blade contact with the surface of the coating.

26. Apparatus for depositing coating constituents on a traffic surface, for mixing the constituents in situ to form a coating, for applying and mixing the coating in a controlled manner to the traffic surface, and for smoothing the coating comprising:

(a) carriage means including structure supporting a plurality of horizontally spaced bearing assemblies;

(b) a separate vertically extending drive shaft journalled by each of the bearing assemblies for rotation about a separate vertically extending axis;

(c) drive means for concurrently drivingly connecting all of the drive shafts to a source of rotary motion for concurrently rotating the drive shafts; and, (d) a plurality of rotary tool means with each of the rotary tool means being connected to a separate one of the drive shafts for stirring coating constituents that have been deposited upon a traffic surface and for finishing the surface of the resulting coating in response to rotation of the rotary tool means by the drive means when the carriage means is operative to position the rotary tool means to engage coating constituents that have been deposited upon a traffic surface, with each of the rotary tool means comprising:

(i) a support structure mounted for rotation about the associated vertically extending axis;

(ii) a plurality of blades depending from the support structure in position to be substantially radiating from the associated axis;

(iii) means for so mounting each blade upon the support structure as to preserve a fixed angular relationship about the associated axis through the lengthwise center of the blades;

(iv) means for mounting each blade for limited bodily movement to and from the support structure including means for urging the blade downwardly away from the support structure means; and, (v) means for rockably mounting each blade for limited rocking movement end-for-end about another axis that extends substantially parallel to the traffic surface.

27. The apparatus of claim 26 additionally including at least one separate dispensing means for dispensing an ingredient of the ultimate composition at a location spaced from the location where said plurality of dispensing means deposit ingredients in close proximity to each other.

28. The apparatus of claim 26 wherein at least two of the rotary tools have their axes oriented relatively forwardly and rearwardly with respect to a forward path of travel that is followed by the apparatus in moving over the traffic surface.

29. The apparatus of claim 26 wherein at least two of the rotary tools have their axes oriented in side by side relationship relatively to a forward path of travel that is followed by the apparatus in moving over the traffic surface.

30. Apparatus for depositing coating constituents on a traffic surface, for mixing the constituents in situ to form a coating, and for applying the coating in a controlled manner to the traffice surface, comprising:

(a) carriage mans including structure supporting a plurailty of horizontally spaced bearing assemblies;

(b) a separate vertically extending drive shaft journaled by each of the bearing assemblies for rotation about a separate vertically extending axis;

(c) drive mans for concurrently drivingly connecting all of the drive shafts to a source of rotary motion for concurrently rotating the drive shafts about their associated ones of said vertically extending axes; and, (d) a plurality of rotary tool means with each of the rotary tool means being connected to a separate one of the drive shafts for stirring coating constitents that have been deposted upon a traffic surface and for finishing the surface of the resulting coating in response to rotation of the rotary tool means by the drive means when the carriage means is operative to position the rotary tool means to engage coating constituents that have been deposited upon a traffic surface, with each of the rotary tool means comprising:

(i) a support structure mounted for rotation about the associated vertically extending axis;

(ii) a plurality of blades depending from the support structure in position to be substantially radiating from the assocaited axis;

(iii) blade mounting means for so mounting each blade upon the support structure as to preserve a fixed angular relationship about the associated axis through the lengthwise center of the blades, with the blade mounting means including means for altering the fixed angular relationship which the blade makes with said associated axis;

(iv) means for mounting each blade for limited bodily movement to and from the support structure including means for urging the blade downwardly away from the support structure means; and, (v) means for rockably mounting each blade for limited rocking movement end-for-end about another axis that extends substantially parallel to the traffic surface.

31. The apparatus of claim 30 which further includes a depending skirt that extends about at least a portion of the perimeter of the plurality of rotary tool means to substantially enclose the blades and closely approach the traffic surface to be coated.

32. An apparatus for depositing coating ingredients upon a traffic surface, comprising:

(a) dispensing means for dispensing coating ingredients onto a traffice surface;

(b) a plurality of rotary tool means for rotation about separate axes that extend substantially normal to the traffic surface for stirring the deposted coating ingredients about on the traffic surface and for applying and smoothing the deposited ingredients to the traffic surface;

(c) mobile support and drive means for supporting the dispensing means and the rotary tool means, and for rotating the rotary tool means about said axes; and, (d) each of the rotary tool means including:

(i) separate support structure means connected to the mobile support and drive means for rotation about its associated one of said separate axes;

(ii) separate stirring and applicator means including a plurailty of blade-like tools positioned below the associated support structure means at locations spaced about and substantially radiating from said associated axis; and, (iii) mounting means movably connecting the blade-like tools to the support structure means for permitting limited movements of the blade-like tools in directions extending toward and away from the traffic surface, and for permitting rocking movements of the blade-like tools about axes that extend substantially parallel to the traffic surface.

33. A rotary tool apparatus for forming a coating composition on a traffic surface by mixing and spreading applied ingredients deposited thereon and for smoothly spreading the same thereover irrespective of the lateral traffic surface dimensions, comprising:

(a) a frame having a plurailty of vertically directed thrust bearing means each extending about a separate horizontally spaced, vertically extending axis of rotation;

(b) power drive means carried on the frame means on the upper side thereof and including a plurality of drive shafts each of which is drivingly connected to a source of rotary motion for concurrent rotation about a separate one of said axes, with each of the drive shafts extending through a separate one of said thrust bearing means;

(c) a plurality of carriage means, with each of the carriage means being disposed about a separate one of said axes and including a thrust bearing for receiving a separate one of said drive shafts for supporting the frame and drive means thereby, and with each of said carriage means further including wheel means for providing traffic surface support thereby to permit translation of said apparatus with respect to the traffic area undergoing treatment;

(d) a plurality of rotary finishing assemblies each including:

(i) a plurality of tool arms connected to and extending radially from a separate one of said shafts;

(ii) a surface-engaging tool connected to each said arm at its distal end whereby said tools will rotate in a horizontal plane upon rotation of said drive shaft by said power means thereby to effect treatment of the traffic surface;

(iii) mans mounting each said tool arm for vertical movement with respect to the associated drive shaft and with respect to said tool connected thereto to accommodate irregularities in the treated surface while maintaining the orientation of the tool with respect thereto; and, (iv) means yieldably biasing at least selected ones of said tool arms downwardly to maintain the associated tools in contact with the treated surface; and, (e) means for adjusting each tool for a vertical axis with respect to its tool arm thereby to predetermined the character and extent of trying applied to the traffic surface.

* * * * *